US010114329B2

(12) United States Patent
Tadomi et al.

(10) Patent No.: US 10,114,329 B2
(45) Date of Patent: Oct. 30, 2018

(54) IMAGE FORMING APPARATUS WHICH CONTROLS PERIOD BETWEEN TRAILING EDGE OF PRECEDING SHEET AND LEADING EDGE OF NEXT SHEET

(71) Applicant: CANON KABUSHIKI KAISHA, Tokyo (JP)

(72) Inventors: Takuma Tadomi, Toride (JP); Tatsuhito Watanabe, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/601,785

(22) Filed: May 22, 2017

(65) Prior Publication Data

US 2017/0343938 A1 Nov. 30, 2017

(30) Foreign Application Priority Data

May 27, 2016 (JP) ..... 2016-106456
Jun. 29, 2016 (JP) ..... 2016-129401

(51) Int. Cl.
*G03G 15/00* (2006.01)
*G03G 15/20* (2006.01)

(52) U.S. Cl.
CPC ..... *G03G 15/6573* (2013.01); *G03G 15/2025* (2013.01); *G03G 15/2028* (2013.01); *G03G 15/6529* (2013.01); *G03G 2215/00949* (2013.01); *G03G 2215/0129* (2013.01); *G03G 2215/2045* (2013.01)

(58) Field of Classification Search
CPC ..... G03G 15/6573; G03G 15/657; G03G 21/203; G03G 2215/00413; G03G 2215/00417; G03G 2215/00949; G03G 2215/2045; G03G 15/6529
USPC ..... 399/44, 68, 85, 329, 331, 396, 400
See application file for complete search history.

(56) References Cited

U.S. PATENT DOCUMENTS

| | | | | |
|---|---|---|---|---|
| 7,801,456 | B2 * | 9/2010 | Otsuka | G03G 15/2039 399/406 |
| 9,261,826 | B2 * | 2/2016 | Kataoka | G03G 15/2028 |
| 9,341,999 | B2 * | 5/2016 | Seshita | G03G 15/2042 |
| 2009/0060561 | A1 * | 3/2009 | Okabayashi | G03G 15/2039 399/94 |
| 2012/0328317 | A1 * | 12/2012 | Matsuo | G03G 15/2078 399/68 |

(Continued)

FOREIGN PATENT DOCUMENTS

| | | | |
|---|---|---|---|
| JP | 08262822 | A * | 10/1996 |
| JP | 2007101861 | A | 4/2007 |
| JP | 2008216383 | A * | 9/2008 |

*Primary Examiner* — Robert Beatty
(74) *Attorney, Agent, or Firm* — Canon U.S.A., Inc. IP Division

(57) ABSTRACT

An image forming apparatus includes an image forming device, a fixing device including a first rotary member of which a surface layer containing a fluororesin is brought into contact with a sheet surface having an unfixed toner image formed by the image forming device, and a controller. In a case that image formation processing for continuously forming a toner image on a plurality of predetermined sheets is executed, the controller can control conveyance of a sheet so that a portion of the surface layer of the first rotary member which is brought into contact with a trailing edge of a preceding sheet is brought into contact with a margin area on a leading edge side on a next sheet.

26 Claims, 23 Drawing Sheets

(56) References Cited

U.S. PATENT DOCUMENTS

| | | | | |
|---|---|---|---|---|
| 2015/0277317 | A1* | 10/2015 | Okabayashi | G03G 15/2046 399/68 |
| 2015/0346660 | A1* | 12/2015 | Usui | G03G 15/2039 399/68 |
| 2017/0139373 | A1* | 5/2017 | Honke | G03G 21/203 |

* cited by examiner

IMAGE FORMING APPARATUS WHICH CONTROLS PERIOD BETWEEN TRAILING EDGE OF PRECEDING SHEET AND LEADING EDGE OF NEXT SHEET

BACKGROUND OF THE INVENTION

Field of the Invention

The present disclosure relates to an electrophotographic method image forming apparatus.

Description of the Related Art

Regarding image forming apparatuses, a method is known in which heat and pressure are applied to a sheet, and an unfixed toner image formed on the sheet is fixed onto a recording material. According to Japanese Patent Application Laid-Open No. 2007-101861, a configuration is described which pinches and conveys a sheet by a nip portion formed by a fixing film heated by a heater and a pressing roller and fixes an unfixed toner image onto the sheet by heat from the heater through the fixing film.

However, when a sheet passes through the nip portion, separation discharge may occur between a fixing member (e.g., the fixing film) and a trailing edge of the sheet in some cases. When the separation discharge occurs between the fixing member and the trailing edge of the sheet, potential variations are generated at a portion at which the separation discharge occurs and a portion at which the separation discharge does not occur on a surface of the fixing member. When an image forming apparatus described in Japanese Patent Application Laid-Open No. 2007-101861 continuously performs fixing processing on a plurality of sheets, the separation discharge occurs between a trailing edge of a preceding sheet and the fixing film, and there is a possibility that a portion of the fixing film at which the separation discharge occurs is brought into contact with an image area of a next sheet. When the portion of the fixing film at which the separation discharge occurs is brought into contact with an unfixed toner image of a subsequent sheet, there is a possibility that the toner image on the sheet may be disturbed which may become apparent as a streak-like image defect (hereinbelow, referred to as an image streak).

SUMMARY OF THE INVENTION

Thus, the present disclosure is directed to the provision of an image forming apparatus capable of restraining an image streak due to separation discharge at a fixing device from becoming apparent on an output object.

According to an aspect of the present invention, an image forming apparatus includes an image forming device configured to form an unfixed toner image on a sheet continuously conveyed, a fixing device configured to fix the unfixed toner image formed by the image forming device on the sheet while conveying the sheet continuously conveyed from the image forming device, wherein the fixing device includes a first rotary member of which a surface layer containing a fluororesin is brought into contact with a sheet surface having the unfixed toner image formed by the image forming device and a second rotary member configured to form a nip portion in cooperation with the first rotary member, and a controller configured to execute a first mode and a second mode, wherein, in the first mode in a case that image formation processing for continuously forming a toner image on a plurality of predetermined sheets is executed, the controller controls conveyance of a sheet so that a period from when a trailing edge of a preceding sheet in the plurality of sheets passes through the nip portion to when a leading edge of a next sheet reaches the nip portion is a first period, and a portion of the surface layer of the first rotary member, which is brought into contact with the trailing edge of the preceding sheet, is brought into contact with an image area on the next sheet without being contact with a margin area on a leading edge side on the next sheet, and wherein, in the second mode in the case that the image formation processing is executed, the controller controls conveyance of a sheet so that the period is longer than the first period, and the portion of the surface layer of the first rotary member, which is brought into contact with the trailing edge of the preceding sheet, is brought into contact with the margin area on the leading edge side on the next sheet.

Further features will become apparent from the following description of embodiments with reference to the attached drawings.

DESCRIPTION OF THE EMBODIMENTS

Embodiments will be described in detail below with reference to the attached drawings. Components described in the embodiments are merely examples, and thus, the present invention is in no way limited to the following embodiments.

<Image Forming Apparatus>

Figure 1:
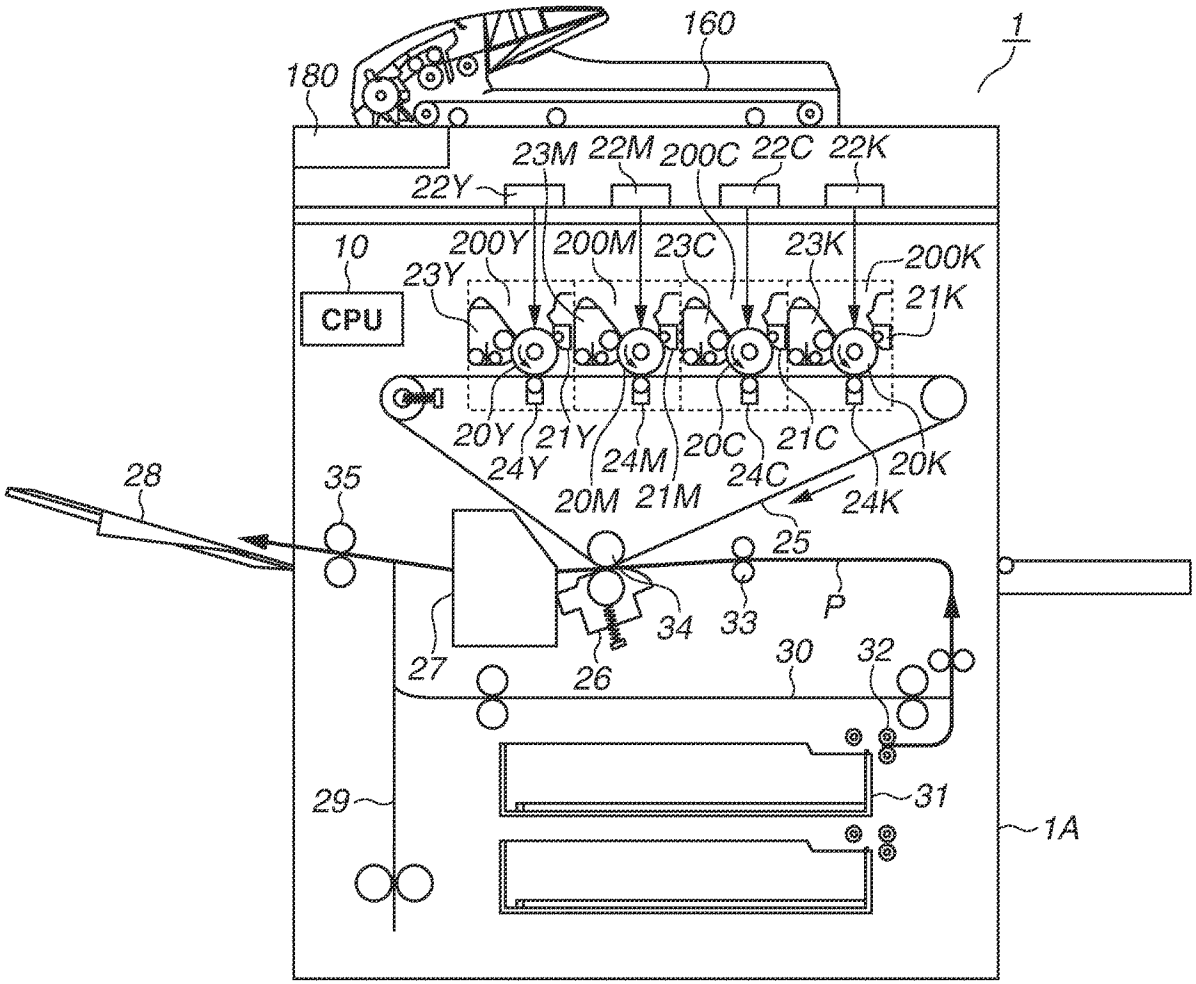
FIG. 1 illustrates an example of an image forming apparatus.

FIG. 1 illustrates an example of an image forming apparatus. An image forming apparatus 1 includes image forming devices 200Y, 200M, 200C, and 200K which form images on a recording material by the electrophotographic method and a fixing device 27 which performs fixing processing on an unfixed image formed on the recording material by applying heat and pressure. According to a first embodiment, an apparatus including full color intermediate transfer method image forming devices is described as an example of the image forming apparatus 1, however, embodiments are not limited to the present embodiment. For example, the image forming apparatus 1 may be a direct transfer system apparatus which directly transfers an image from a photosensitive drum 20 to a recording material not via an intermediate transfer belt 25 described below and an apparatus which forms a single color toner image (e.g., a monochromatic apparatus). In addition, the image forming apparatus 1 may be a copying machine, a printer, a facsimile apparatus, and multifunction peripheral having a plurality of these functions.

A reading device 160 is provided on an upper part of the image forming apparatus 1. The reading device 160 is provided with a document platen (a placing unit) on which an operator places a document, a document cover (a cover unit) for covering the placed document, and a document reading unit including a charge coupled device (CCD) for reading image information of the document. When the operator inputs an instruction to start copying by an operation unit 180 in the image forming apparatus 1, the reading device 160 performs image formation based on the image information read by the document reading unit. Information corresponding to a size and a type of a sheet P on which a toner image is formed and the number of sheets is input from the operation unit 180 by the operator as an instruction. How to specify a size and a type of the sheet P on which a toner image is formed is not limited to an input of an instruction from the operation unit 180. For example, when there is no instruction from the operation unit 180, a size of the sheet P on which a toner image is formed may be adjusted to a size of a document read by the reading device 160.

The image forming apparatus 1 according to the present embodiment can be used as a printer. Specifically, the image forming apparatus 1 is configured to be able to connect to an external personal computer (not illustrated) via a local area network (LAN) cable (a communication line) (not illustrated) and execute image formation based on the image information input from the connected external personal computer. In this regard, the information corresponding to the size, the type, and the number of the sheets P on which the toner image is formed is input to a central processing unit (CPU) 10 from the connected external personal computer. The image forming apparatus 1 performs the image formation in response to an input of the image information from the connected external personal computer. In this case, the image forming apparatus 1 is input an instruction to start printing from the external personal computer together with the image information. The image forming apparatus 1 may be configured not to execute the image formation immediately when the image information is input from the connected external personal computer and start the image formation after the instruction to start printing is input from the operation unit 180.

Figure 11:
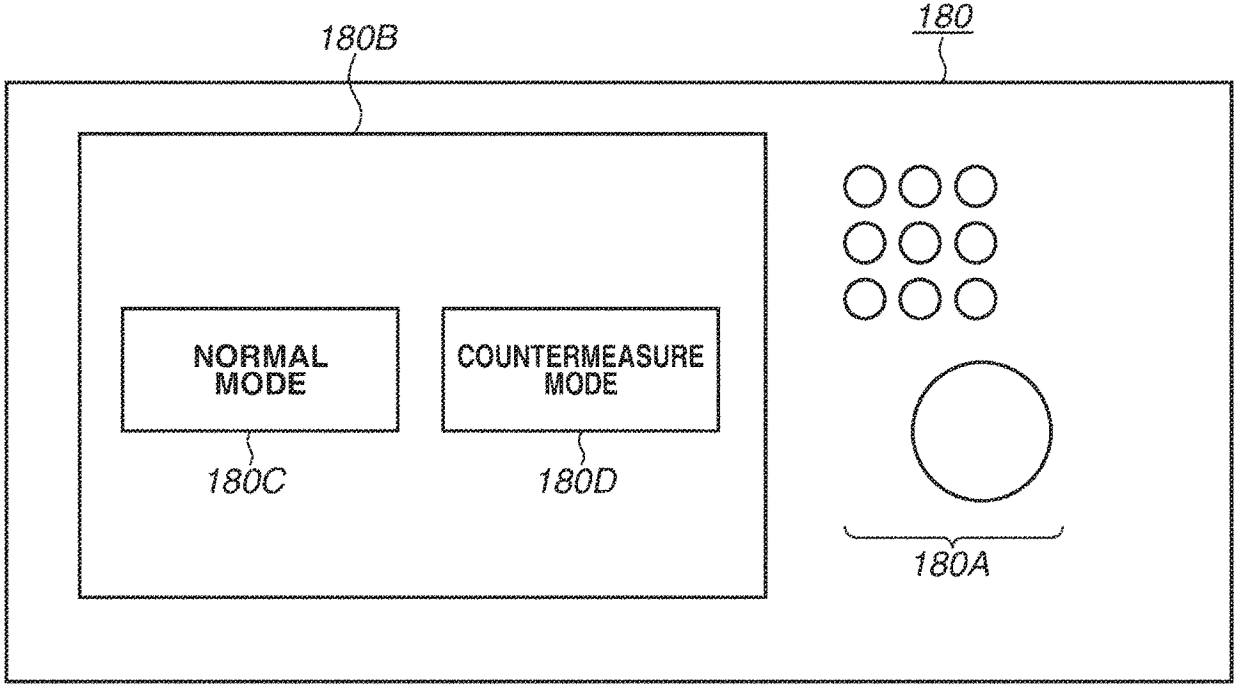
FIG. 11 illustrates an example of the mode selection screen.

The operation unit 180 functions as an input unit to which various information pieces are input by the operator and a display unit for displaying the information. According to the present embodiment, the operation unit 180 includes an operation button unit 180A to which an instruction is input by the operator and a display unit (an information display unit) 180B for displaying various messages and the like as illustrated in FIG. 11. The display unit 180B is a touch panel type liquid crystal screen which displays various messages and various operation buttons (keys). Various settings of a print operation performed by the image forming apparatus 1 can be input by the displayed operation buttons. Instructions to start copying and printing and others by the operator can be input from the operation unit 180.

In a main body 1A of the image forming apparatus 1, the four image forming devices 200Y, 200M, 200C, and 200K respectively corresponding to colors of yellow (Y), magenta (M), cyan (C), and black (K) are arranged in series. In other words, a tandem type is adopted which performs processes for visualizing an image in parallel by the respective colors of yellow (Y), magenta (M), cyan (C), and black (K).

To simplify the description hereinbelow, the image forming device 200 is described as a representative for the four image forming devices of the respective Y, M, C, and K colors, and the same applies to related following process units. In addition, an arrangement order of the image forming devices 200 of the respective Y, M, C, and K colors is not limited to this order.

Each image forming device 200 includes each of following electrophotographic process units. More specifically, the photosensitive drum 20 as an image bearing member for bearing an electrostatic latent image on a surface, a primary charging device 21, an exposure device 22, a development device 23, a primary transfer device 24, and a cleaning device (not illustrated) are provided corresponding to each of the Y, M, C, and K colors.

The photosensitive drum 20 is driven to rotate in a counterclockwise in FIG. 1. The primary charging device 21 applies voltage and uniformly charges a surface of the corresponding photosensitive drum 20. The charged surface of the photosensitive drum 20 is exposed with light by the exposure device 22 corresponding to image data, and thus an electrostatic latent image is formed on the photosensitive drum 20. The electrostatic latent image on the photosensitive drum 20 is developed by the development device 23 using a toner (developer) and visualized as a toner image. According to the present embodiment, the toner is negatively charged by the development device 23 and developed on the photosensitive drum 20.

The toner image on the photosensitive drum 20 developed by the development device 23 is primary transferred by being sequentially overlapped by the primary transfer device 24 on the intermediate transfer belt (an intermediate transfer member) 25 which is an endless belt. After the primary transfer, the toner remaining on the photosensitive drum 20 is removed by the cleaning device (not illustrated).

A full color toner image which is formed on the intermediate transfer belt 25 by overlapping the toner images of all of the Y, M, C, and K colors is then collectively secondary transferred by a secondary transfer device 26 to the sheet P as a recording medium (sheet) fed to the secondary transfer device 26. A counter roller 34 on the inside of the intermediate transfer belt 25 and the secondary transfer device 26 form a transfer nip portion via the intermediate transfer belt 25. The toner image formed on the intermediate transfer belt 25 is transferred to the sheet P at the transfer nip portion by the secondary transfer device 26.

The sheet P as a recording medium is a medium on which an image is formed by the image forming apparatus 1 and includes, for example, plain paper, coated paper, thick paper, thin paper, an envelope, and the like.

A cassette 31 is a storage unit for storing the sheet P used in the image formation. A sheet feeding roller 32 separates and feeds out the sheets P in the cassette 31 one by one. The sheet P fed from the cassette by the sheet feeding roller 32 is conveyed to a registration roller 33 and temporarily stopped by the registration roller 33. The registration roller 33 feeds out the sheet P to the transfer nip portion in accordance with a timing at which the toner image on the intermediate transfer belt 25 reaches the transfer nip portion so that the toner image formed on the intermediate transfer belt 25 is transferred on a predetermined position of the sheet P at the transfer nip portion.

The sheet P on which the toner image is transferred at the transfer nip portion is conveyed to the fixing device (a fixing unit) 27.

The fixing device 27 applies heat and pressure to the sheet P bearing an unfixed toner image while pinching and conveying it by a fixing nip portion (nip portion) N. Accordingly, the fixing device 27 fixes the toner image on the sheet P to the sheet P. The fixing device 27 is described in detail below. The sheet P on which the toner image is fixed by the fixing device 27 is discharged by a sheet discharge roller 35 to a sheet discharge tray 28.

When an image is formed on a rear surface side, the sheet P on which the toner image of a first surface (a front surface side) is fixed by the fixing device 27 is reversed by a reversing path 29 and then conveyed to a conveyance path 30. Further, the sheet P on which the toner image of the first surface (the front surface side) is fixed by the fixing device 27 is conveyed again to the transfer nip portion, and the toner image is transferred on the rear surface side thereof. Subsequently, the sheet P on whose rear surface side the toner image is transferred is subjected to the fixing processing by the fixing device 27 and discharged by the sheet discharge roller 35 to the sheet discharge tray 28.

<Fixing Device>

Figure 2:
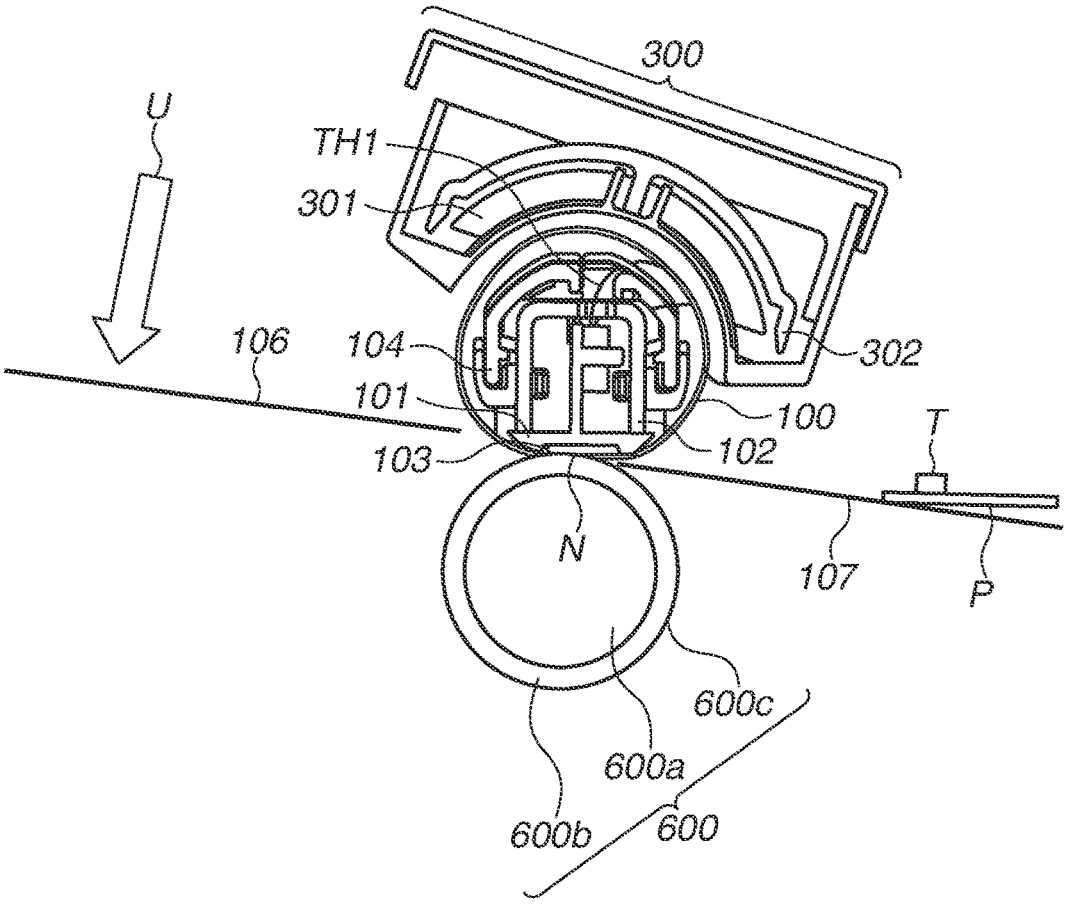
FIG. 2 is a cross-sectional view illustrating an example of a fixing device.
Figure 3A:
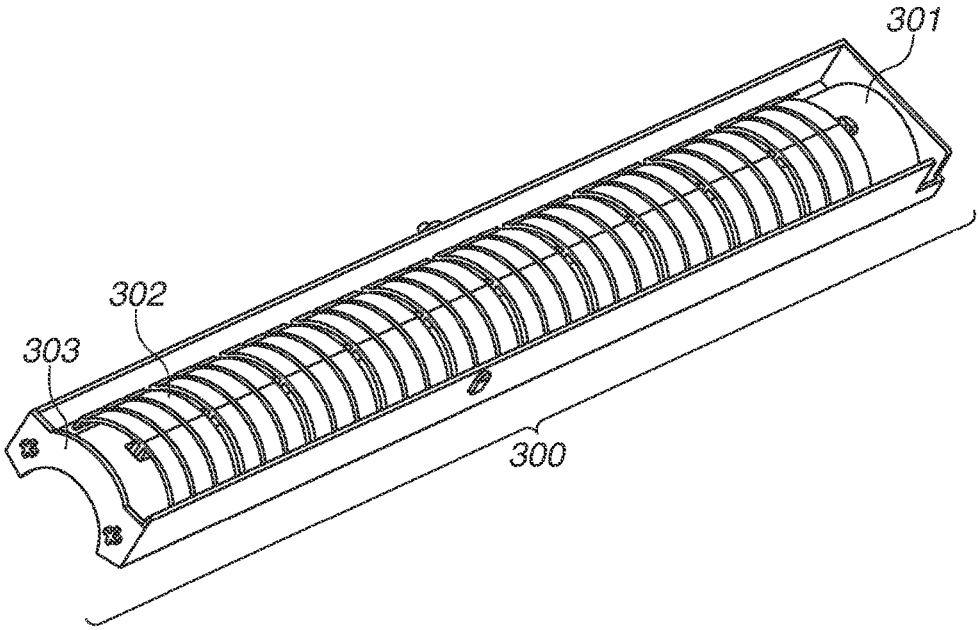
FIG. 3A illustrates a configuration of an induction heating device in a longitudinal direction.
Figure 3B:
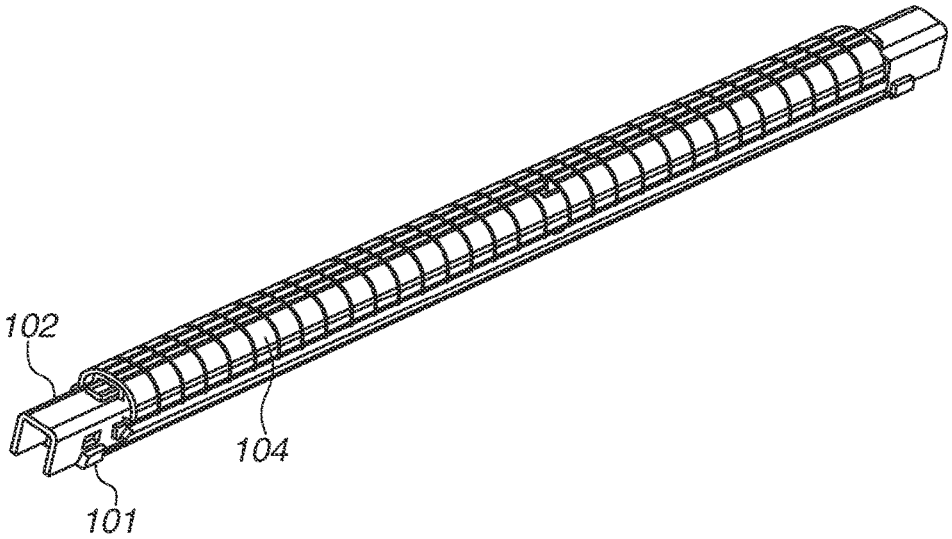
FIG. 3B illustrates a configuration of an internal core in the longitudinal direction.
Figure 4:
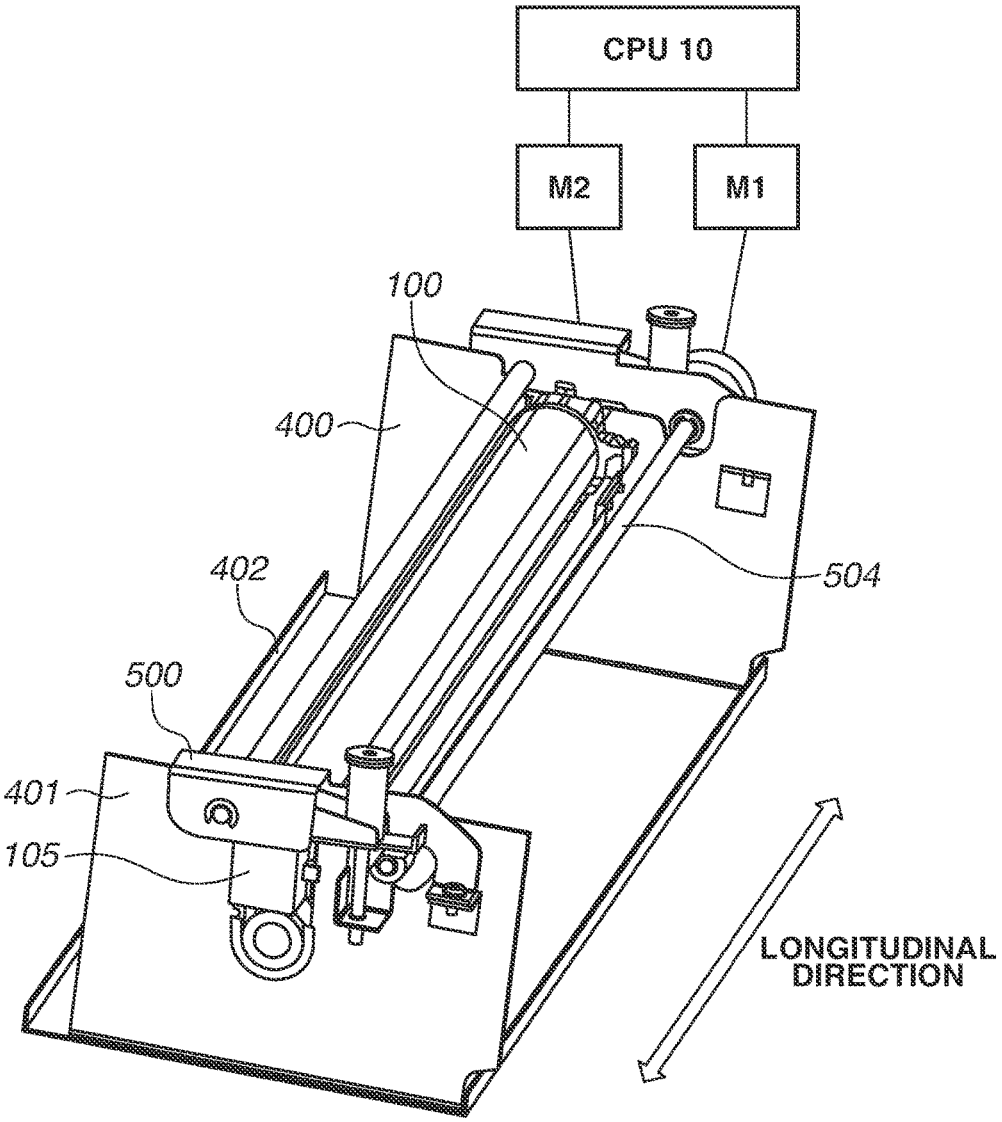
FIG. 4 illustrates a configuration of the fixing device in the longitudinal direction.
Figure 5:
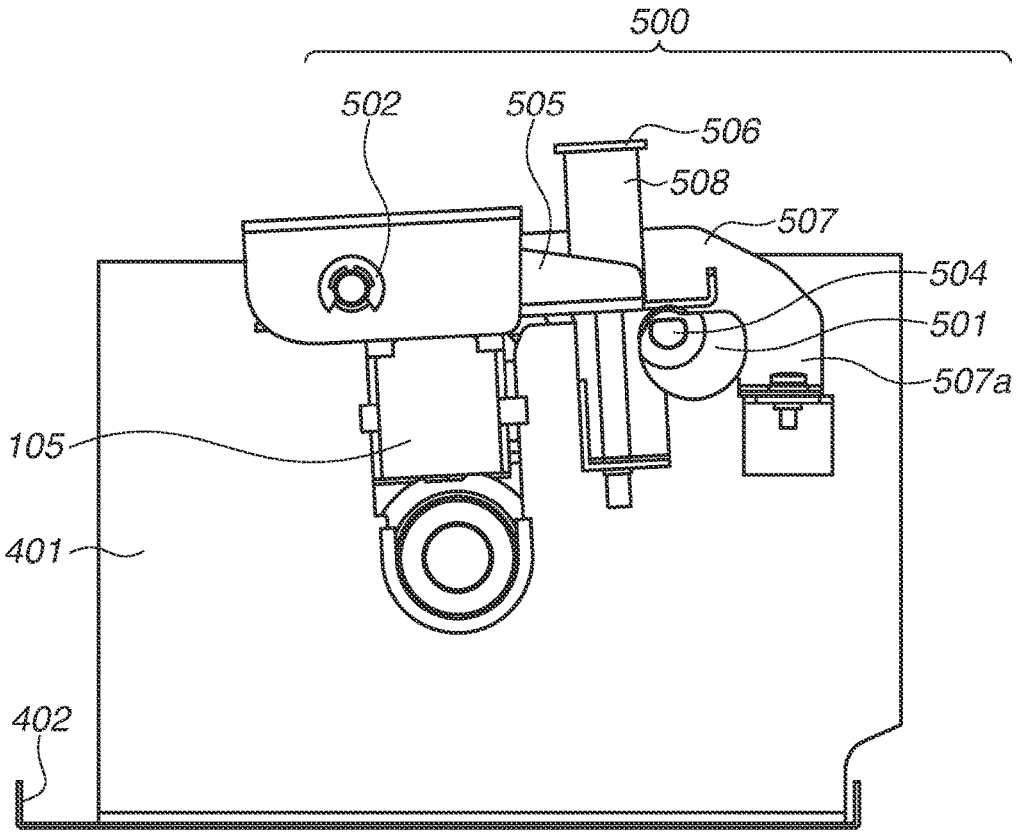
FIG. 5 illustrates an example of a pressing mechanism of the fixing device.

Next, a configuration of the fixing device 27 is described with reference to FIGS. 2 to 6. FIG. 2 is a cross-sectional view illustrating an example of the fixing device. FIG. 3A illustrates a configuration of an induction heating device in the longitudinal direction, and FIG. 3B illustrates a configuration of an internal core in the longitudinal direction. FIG. 4 illustrates a configuration of the fixing device in the longitudinal direction. FIG. 5 illustrates an example of a pressing mechanism of the fixing device.

A fixing belt 100 as a fixing rotary member (a rotary member) and a pressing roller 600 as a pressing rotary member (a rotary member) cooperatively form the fixing nip portion N as a pair of rotary members. An induction heating device 300 described below heats the fixing belt 100. The fixing belt 100 is an endless belt having a metal layer and inductively heated by the induction heating device 300 described below. The pressing roller 600 is disposed so as to be in contact with an outer circumference of the fixing belt 100. A pad member 101 provided on the inside of the fixing belt 100 applies a pressing force between the pressing roller 600 so that the fixing belt 100 and the pressing roller 600 form the fixing nip portion N. The fixing device 27 pinches and conveys the sheet P at the fixing nip portion N and applies heat and pressure to the sheet P bearing the toner image so as to fix the toner image. The fixing belt 100 is brought into contact with a surface (a sheet surface) of the sheet P on which the unfixed toner image is borne.

The pad member 101 is a member for forming the fixing nip portion N by applying a pressing force between the fixing belt 100 and the pressing roller 600 and is held by a stay 102 made of metal. The pad member 101 is a heat-resistant resin and supports a fixing pad 13 on the pressing roller 600 side. The fixing pad 13 is made of a high hardness material, for example, a metal such as stainless steel and ceramic and has a thickness of about 1 mm and a shape extending in the longitudinal direction of the fixing belt 100.

A separation guide 106 is a guide member disposed on a downstream side of the fixing nip portion N in a conveyance direction of the sheet P so that the sheet P passing through the fixing nip portion N does not wind around the fixing belt 100. The separation guide 106 is disposed with a certain distance (interval) from the fixing belt 100 so as not to scratch the fixing belt 100 by being contact with the fixing belt 100. The separation guide 106 engages with a part of a flange 105 and is fixed by an urging unit such as a spring.

(Induction Heating Device)

The induction heating device 300 is a heating source (an induction heating unit) for inductively heating the fixing belt 100. The induction heating device 300 includes an excitation coil 301, an outer magnetic body core 302, a coil holding member 303, and a power source device (not illustrated). The excitation coil 301 is formed into a horizontally long ship bottom shape using, for example, a litz wire as an electrical wire and wound around so as to face a circumferential surface and a part of a side surface of the fixing belt 100. The power source device (an excitation circuit) applies a high frequency electric current of 20 to 60 kHz to the excitation coil 301 in a state in which the fixing belt 100 is rotated. A magnetic flux generated in the excitation coil 301 by the high frequency electric current causes induction heating in a metal layer (a conductive layer) of the fixing belt 100. The outer magnetic body core 302 covers the excitation coil 301 so that the magnetic flux generated by the excitation coil 301 does not substantively leak other than the metal layer (the conductive layer) of the fixing belt 100. The outer magnetic body core 302 is made of a high magnetic permeability material such as ferrite for shielding the magnetic flux so that the magnetic flux generated in the excitation coil 301 by applying the high frequency electric current is more efficiently used for heating of the fixing belt 100.

The coil holding member 303 is an electric insulating resin having a thickness of about 2 mm for supporting the excitation coil 301 and the outer magnetic body core 302. The induction heating device 300 is arranged on an upper side of an outer circumferential surface of the fixing belt 100 with a predetermined gap (clearance) to the fixing belt 100.

Further, in the inside of the fixing belt 100, an internal core 104 is disposed on a coil side of the stay 102 so as to more effectively perform induction heating. The internal core 104 is made of a high magnetic permeability material such as ferrite for shielding the magnetic flux so that the magnetic flux generated in the excitation coil 301 by applying the high frequency electric current is more efficiently used for heating of the fixing belt 100.

The fixing device 27 further includes a temperature sensor TH1 for detecting a temperature of the fixing belt 100. The temperature sensor TH1 is a temperature detection element such as a thermistor. The temperature sensor TH1 is disposed so as to be in contact with an inner surface of the fixing belt 100 at a center part of the fixing belt 100 in the longitudinal direction. The temperature sensor TH1 is connected to the CPU 10. The CPU 10 controls electricity input from the power source device to the excitation coil 301 based on a detected temperature input from the temperature sensor TH1 so that the fixing belt 100 is maintained at a target temperature (e.g., 180° C.). According to the present embodiment, the CPU 10 changes a frequency of the high frequency electric current input by the power source device based on a detection value of the temperature sensor TH1 so that the temperature of the fixing belt 100 is to be constant at 180° C. as the target temperature.

According to the present embodiment, the electromagnetic induction type induction heating device 300 is disposed as a heating unit of the fixing belt 100, however, the heating unit of the fixing belt 100 is not limited thereto. For example, a heating source such as a halogen heater, a ceramic heater, and an infrared lamp may be disposed on the inside of the fixing belt 100. The heating source of the fixing belt 100 may be disposed on the outside of the fixing belt 100. Further, a heating source for heating the pressing roller 600 may be further disposed.

(Fixing Belt)

Figure 6:
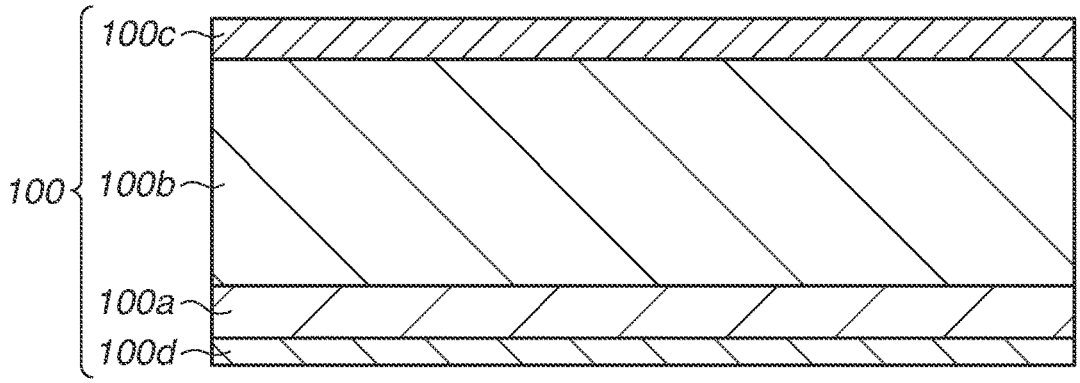
FIG. 6 illustrates a configuration of a fixing belt.

FIG. 6 illustrates a configuration of the fixing belt of the fixing device which is a cross section of the fixing belt 100. The fixing belt 100 which is an endless belt includes a lubricating layer 100*d*, a base layer 100*a*, an elastic layer 100*b*, and a release layer 100*c* in this order from the inside to the outside thereof.

The base layer 100*a* is a metal layer with an inner diameter of about 20 to 40 mm. As the base layer 100*a* of the fixing belt 100, an iron alloy, a nickel alloy, copper, silver, and others can be appropriately selected. The fixing belt 100 according to the present embodiment has an outer diameter of 30 mm, and the inner diameter of the base layer 100*a* thereof is about 29.6 mm.

The elastic layer 100*b* provided on an outer circumference of the base layer 100*a* is a heat-resistant rubber layer. A thickness of the rubber layer may be set within a range of 100 to 800 micrometer (μm). According to the present embodiment, the thickness of the rubber layer is set to 200 μm in consideration of shortening of a warming up time by reducing a heat capacity of the fixing belt 100 and obtainment of a better fixed image when a color image is fixed On an outer circumference of the elastic layer 100*b*, the release layer 100*c* is provided as a surface layer, and a surface resistance of the fixing belt 100 is 1.0 e+6(Ω)) or more. The release layer 100*c* is a fluororesin (e.g., perfluoroalkoxy alkane (PFA) and polytetrafluoroethylene (PTFE), or other polymer including many hydroxyls) layer. The release layer 100*c* is a surface layer of the fixing belt 100 and enhances releasability to a toner. Further, according to the present embodiment, a thickness of the release layer 100*c* is 40 μm. The release layer 100*c* may include carbon black in addition to the fluororesin within a range satisfying the above-described surface resistance.

In addition, the high slidable lubricating layer 100*d* having a thickness of 10 to 50 μm may be disposed on an inner surface side of the base layer 100*a* to reduce sliding friction with the temperature sensor TH1. According to the present embodiment, a polyimide layer having a thickness of 30 μm is disposed as the lubricating layer 100*d*, and a heat-resistant grease is applied on a surface thereof as a lubricant. Accordingly, lubricity of the inner surface of the fixing belt 100 can be maintained.

(Pressing Roller)

The pressing roller (the pressing rotary member) 600 for forming the fixing nip portion N between the fixing belt 100 is provided with a core metal 600*a* which is made of metal and has an outer diameter of 30 mm, an elastic layer 600*b* as a rubber layer, and a release layer 600*c*. The release layer 600*c* is a surface layer of the pressing roller 600 which is a fluororesin layer (e.g., PFA and PTFE).

(Pressing Mechanism)

The fixing device 27 includes a pressing mechanism 500 for pressing the pad member 101 toward the pressing roller 600 side for forming the fixing nip portion N. The stay 102 supporting the pad member 101 is fixed by the flanges 105 on the both end sides thereof. The pressing mechanism 500 applies a pressing force to the flange 105 by a pressing spring 508.

FIG. 5 illustrates an example of the pressing mechanism of the fixing device which illustrates one end side of the fixing device 27 in the longitudinal direction. The pressing mechanism 500 includes a pressing cam 501, a pressing plate rotating shaft 502, a pressing cam rotating shaft 504, a pressing plate 505, a pressing adjusting screw 506, a pressing support plate 507, and the pressing spring 508.

The pressing support plate 507 is supported in such a manner that the pressing plate rotating shaft 502 penetrates through a front side plate 400 and a rear side plate 401 and fixed to each of the front side plate 400 and the rear side plate 401 at a leading edge portion 507*a* disposed on a leading edge of the pressing support plate 507 with means such as screws.

The pressing plate 505 is journaled by the pressing plate rotating shaft 502 and provided rotatably about the pressing plate rotating shaft 502 with respect to the pressing support plate 507.

The pressing spring 508 is a spring for applying a load on the pressing plate 505. The pressing adjusting screw 506 is fastened to the pressing support plate 507. A seat of the pressing adjusting screw 506 shorten a spring length of the pressing spring 508 and applies a load on the pressing plate 505. The pressing plate 505 is supported rotatably with respect to the pressing support plate 507 as described above, and thus moment is generated around the pressing plate rotating shaft 502 due to a compressive force by the pressing spring 508.

The pressing plate 505 is arranged to abut on the flange 105, so that the flange 105 is pressed by the moment generated on the pressing plate 505 toward a direction of the pressing roller 600, and thus the fixing nip portion N is formed between the pressing roller 600 and the fixing belt 100.

The pressing force applied to the flange 105 by the pressing plate 505 can be released by pushing up the pressing plate 505 by the pressing cam 501. When the pressing force is released, the pressing cam 501 having a predetermined amount of eccentricity rotates about the pressing cam rotating shaft 504, pushes up the pressing plate 505, and rotates the pressing plate 505 until the contact between the pressing plate 505 and the flange 105 is released. Accordingly, the pressing force is released. Further, the pressing cam 501 is rotated from a state in which the pressing force is released to abut the pressing plate 505 on the flange 105, so that the pressing force (for example, 550 N) is applied.

The pressing cam rotating shaft 504 is connected to a pressing mechanism motor M1 as a driving source, and the pressing mechanism motor M1 rotates the pressing cam rotating shaft 504, so that the pressing cam 501 is rotated. The pressing mechanism motor M1 is electrically connected to the CPU 10, and the CPU 10 operates the pressing mechanism motor M1 to determine a position of the pressing cam 501. The pressing mechanism 500 can take a pressing state in which the pressing plate 505 applies the pressing force to the flange 105 and a released state in which the pressing force is released.

In FIG. 5, the one end side of the fixing device 27 in the longitudinal direction is illustrated, however, the similar pressing mechanism 500 is provided on the other end side in the longitudinal direction as illustrated in FIG. 4. The pressing cam rotating shaft 504 is also connected to the pressing cam 501 on the other end side. The pressing mechanism motor M1 rotates the pressing cam rotating shaft 504 and thus simultaneously rotates the pressing cams 501 on the both ends. Accordingly, the pressing mechanisms 500 on the both ends can be simultaneously brought into the pressing state and can be simultaneously brought into the released state.

The fixing device 27 includes a drive motor M2 for rotating and driving the pressing roller 600. The drive motor M2 is connected to the core metal 600*a* of the pressing roller 600, and when the drive motor M2 of the pressing roller is driven, the pressing roller 600 is rotated and driven. The CPU 10 is connected to the drive motor M2 and controls rotation and stop of the drive motor M2 of the pressing roller. The fixing belt 100 is rotated by following the pressing roller 600.

Operations of the fixing device 27 when image formation processing corresponding to an input print command is executed are summarized. The print command is a command to the image forming device 200 to execute the image formation processing. The print command is, for example, an instruction to start printing input by the operator from the operation unit 180 or the external personal computer and an instruction to start copying input by the operator from the operation unit 180.

First, the CPU 10 drives the pressing mechanism motor M1 and brings the pressing roller 600 to a state for pressing the fixing belt 100 to form the fixing nip portion N.

The CPU 10 rotates the pressing roller 600 by the drive motor M2 of the pressing roller in a state in which the fixing nip portion N is formed so as to followingly rotate the fixing belt 100. The CPU 10 maintains the fixing belt 100 at a predetermined temperature by the induction heating device 300.

In this state, the fixing device 27 pinches and conveys the sheet P bearing the unfixed toner image conveyed from the transfer nip portion side at the fixing nip portion N, and thus the toner image is fixed to the sheet P. When the fixing processing is continuously performed on a plurality of the sheets P, the fixing belt 100 continues following rotation until the last sheet P completely passes through the fixing nip portion N.

When the last sheet P on which the image formation processing to be executed completely passes through the fixing nip portion N, the CPU 10 stops the rotation of the pressing roller 600 and releases the pressing force by the pressing mechanism 500.

<Generation of Separation Discharge Mark>

When the sheet P passes through the fixing nip portion N, separation discharge may occur between the fixing belt 100 and a trailing edge of the sheet P in some cases. When the separation discharge occurs, a potential becomes higher (to a plus side) at a position where the separation discharge occurred on the fixing belt 100 as a separation discharge mark. When the position of the fixing belt 100 at which the separation discharge occurred is brought into contact with the unfixed toner image on the next sheet P, the toner image on the sheet P may be disturbed and becomes apparent as an image streak. An image defect due to the separation discharge mark is referred to as appearance of the image streak. The separation discharge mark is described in detail below.

The phenomenon that the separation discharge mark occurs is described with reference to FIGS. 7 to 10.

Figure 7:
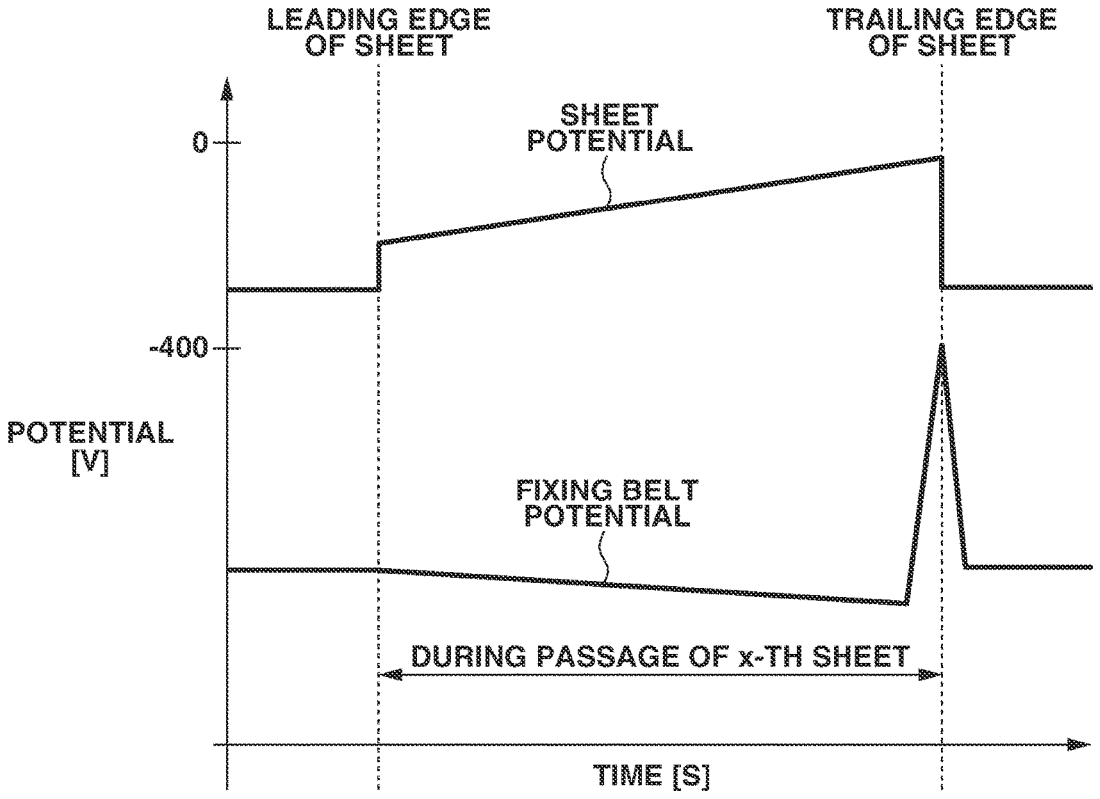
FIG. 7 illustrates transition of a surface potential of the fixing belt and a surface potential of a sheet (x-th sheet).

FIG. 7 illustrates transition of a surface potential of the fixing belt and a surface potential of a sheet (the x-th sheet). FIG. 7 illustrates transition of the surface potential of the sheet and the surface potential of the fixing belt 100 when the x-th sheet P passes through in the case that a plurality of the sheets P continuously passes through the fixing nip portion N in the image forming apparatus 1 according to the present embodiment. An abscissa axis indicates time, and an ordinate axis indicates potential. An area indicated between dotted lines in FIG. 7 is an area in which the x-th sheet is passing though, and areas out of the dotted lines indicate sheet intervals.

Figure 8:
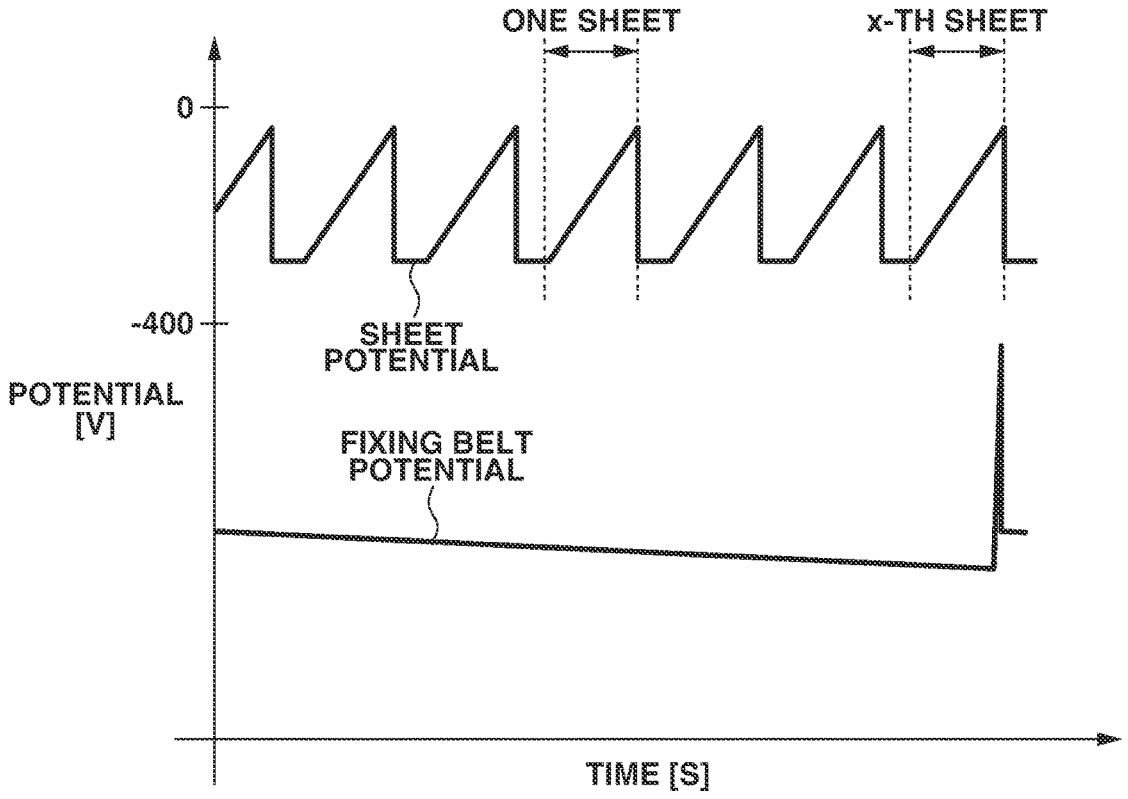
FIG. 8 illustrates transition of the surface potential of the fixing belt and the surface potential of the sheet (when sheets continuously pass through).

FIG. 8 illustrates transition of the surface potential of the fixing belt and the surface potential of the sheet (when sheets continuously pass through). FIG. 8 illustrates transition of the surface potential of the sheet and the surface potential of the fixing belt 100 in the case that the plurality of the sheets P continuously passes through the fixing nip portion N in the image forming apparatus 1 according to the present embodiment. An abscissa axis indicates time, and an ordinate axis indicates potential.

The surface potential of the sheet P is detected at a detection point U (FIG. 2) on the downstream side of the fixing nip portion N.

Further, FIGS. 7 and 8 illustrate states when CS-680 manufactured by CANON Inc. is used as the sheet P. In this regard, the sheet P available to the image forming apparatus 1 is not limited to CS-680 manufactured by CANON Inc.

When the sheet P passes through the fixing nip portion N, the surface of the fixing belt 100 is charged by frictional charge and/or separation charge between the fluororesin layer (PFA according to the present embodiment) which is the surface of the fixing belt 100 and the sheet P. The surface of the fixing belt 100 is negatively charged by the frictional charge and/or the separation charge. As illustrated in FIG. 8, the plurality of the sheets P continuously passes through the fixing nip portion N, and accordingly the surface potential of the fixing belt 100 is gradually lowered.

On the other hand, when the sheets continuously pass through, the surface potential of the sheet P changes on a zero side (plus side) on every sheet P compared to the fixing belt 100. When looking at each sheet, a result was obtained in which the surface potential of the sheet P becomes higher toward a trailing edge portion of the sheet P as illustrated in FIGS. 7 and 8.

In the beginning (until reaching the x-th sheet in FIG. 8), discharge (the separation discharge) does not occur between the fixing belt 100 and the trailing edge of the sheet P, however, the surface potential of the fixing belt 100 becomes larger in the negative polarity according to the continuous sheet passage of the sheets P to the fixing nip portion N. When the surface potential of the fixing belt 100 becomes larger in the negative polarity, a potential difference between the sheet P and the fixing belt 100 becomes larger, and thus the discharge is likely to occur. When the x-th sheet passes through in the state in which the potential of the fixing belt 100 becomes lower, the discharge (the separation discharge) occurs between the fixing belt 100 and the trailing edge of the sheet P. The potential difference between the fixing belt 100 and the sheet P becomes especially larger at the trailing edge portion of the sheet P in the single sheet P. It is not illustrated in FIG. 8, however, the surface potential of the fixing belt 100 becomes larger in the negative polarity according to the continuous sheet passage, so that there is a possibility that the separation discharge repeatedly occurs between the fixing belt 100 and the trailing edge of not only the x-th sheet but also the sheet P subsequent to the x-th sheet.

When the discharge occurs between the fixing belt 100 and the trailing edge of the sheet P, the surface potential of the fixing belt 100 becomes higher at a portion at which the discharge occurred (i.e., the portion being in contact with the trailing edge of the sheet P) than a periphery thereof as illustrated in FIGS. 7 and 8. In the example illustrated in FIG. 7, the surface potential of the fixing belt 100 is negative, so that the potential higher than that of the periphery means that an absolute value of the potential is smaller than that of the periphery. This is a mark of the separation discharge (the separation discharge mark) on the fixing belt 100.

In the area of the sheet interval during the continuous sheet passage, the surface potential of the fixing belt 100 is hardly changed. Thus, the portion at which the separation discharge occurred on the fixing belt 100 maintains the potential of the separation discharge mark. The portion at which the separation discharge occurred on the surface of the fixing belt 100 partially has a potential higher than that of the periphery in a circumferential direction of the fixing belt 100. A subsequent sheet P (the (x+1)-th sheet) bears the unfixed toner image which has weak adhesion of toner to the sheet P. Thus, when the subsequent sheet P (the (x+1)-th sheet) is conveyed at the fixing nip portion N, the portion at which the separation discharge occurred on the surface of the fixing belt 100 is brought into contact with an image area of the subsequent sheet, so that the unfixed toner image on the sheet P is disturbed by the potential of the separation discharge mark. Accordingly, the separation discharge mark becomes apparent as the image streak on the sheet P (the (x+1)-th sheet) as a resultant product which has a possibility to be the image defect.

<Appearance of Image Streak by Separation Discharge Mark>

The present inventors studied and found that when the portion at which the separation discharge occurred is brought into contact with a margin area of the sheet P before the portion at which the separation discharge occurred is brought into contact with the image area of the subsequent sheet, the image streak can be restrained from becoming apparent in the image area of the subsequent sheet.

Figure 9:
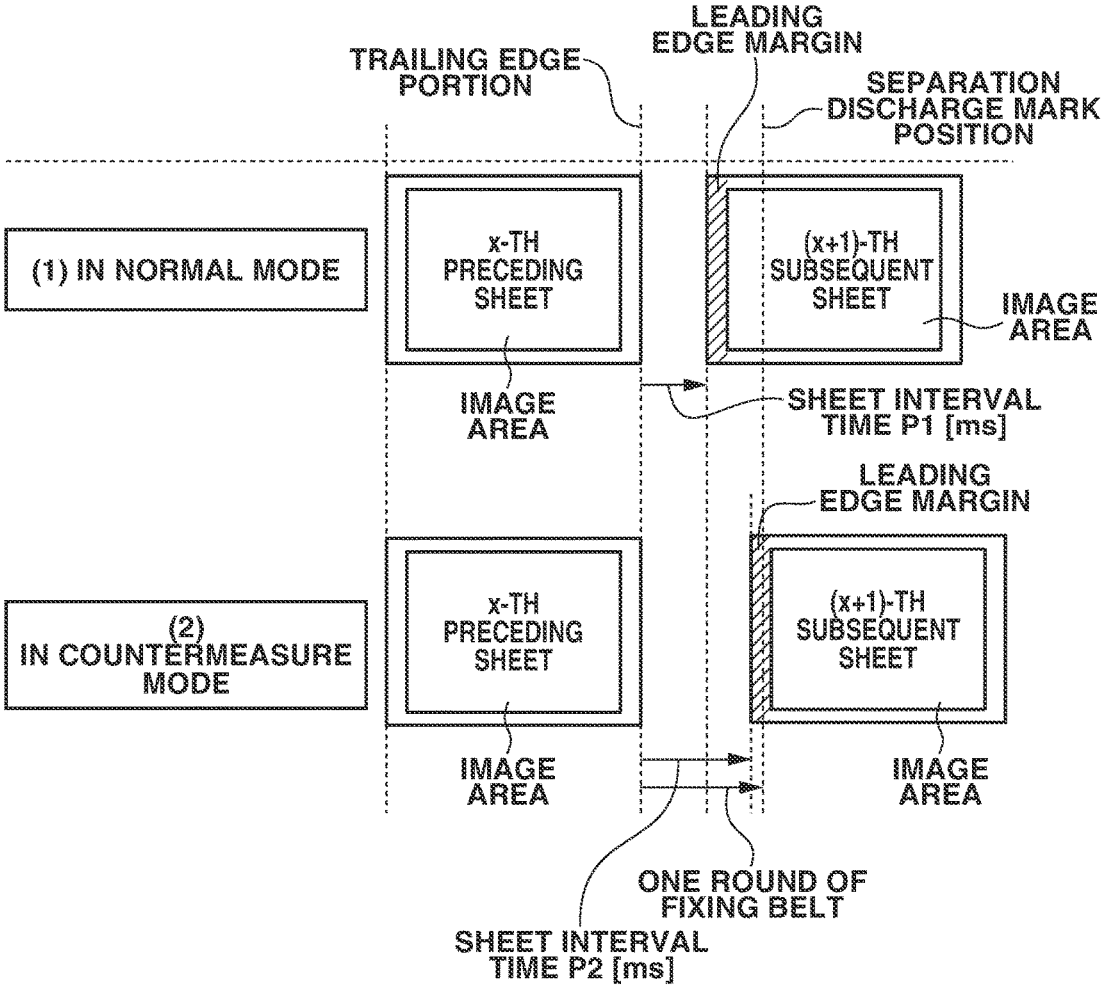
FIG. 9 illustrates a sheet interval of each mode.

FIG. 9 illustrates a sheet interval of each mode. An example is described below in which the image formation is continuously performed on a plurality of predetermined sheets P (i.e., the sheets P having a predetermined size and a predetermined type). The plurality of the sheets P described as the example here has the same size and the same type with each other (i.e., the sheets having the same size, the same basis weight, and the same material). An example is a case when printing is performed on ten sheets of A4 size plain paper.

A normal mode is a mode for prioritizing productivity. In the normal mode, a sheet interval time is P1 (ms), and a portion abutted on a trailing edge of a preceding sheet (the x-th sheet) on the circumference surface of the fixing belt 100 comes into the image area of the subsequent sheet (the (x+1)-th sheet). More specifically, the portion abutted on the trailing edge of the preceding sheet (the x-th sheet) on the circumference surface of the fixing belt 100 is brought into contact with the image area of the subsequent sheet (the (x+1)-th sheet) without being brought into contact with a margin area on a leading edge side of the subsequent sheet (the (x+1)-th sheet). The sheet interval time is a time length (a period) from when a trailing edge of the preceding sheet (the x-th sheet) passes through the fixing nip portion N to when a leading edge of the subsequent sheet (the (x+1)-th sheet) conveyed to the fixing nip portion N next to the preceding sheet reaches the fixing nip portion N. FIG. 9 illustrates a case when the sheet interval in the normal mode is less than one round of the fixing belt 100 in a distance.

A mode for taking a countermeasure against the image defect due to the separation discharge mark (hereinbelow, referred to as a countermeasure mode) is a mode of which productivity is reduced than the normal mode, and the sheet interval time is P2 (ms). In other words, P2>P1. In the countermeasure mode, a portion which is brought into contact with the trailing edge portion of the preceding sheet (the x-th sheet) on the circumference surface of the fixing belt 100 is brought into contact with the margin area on the leading edge side of the subsequent sheet (the (x+1)-th sheet). The sheet interval time P2 in the countermeasure mode is set to a time length calculated from a circumferential length of the fixing belt 100 so that the portion which is brought into contact with the trailing edge portion of the preceding sheet on the circumference surface of the fixing belt 100 comes into the margin area of the subsequent sheet. FIG. 9 illustrates a case when a sheet interval in the countermeasure mode is a sheet interval in which the portion brought into contact with the trailing edge portion of the preceding sheet (the x-th sheet) on the circumference surface of the fixing belt 100 is brought into contact with the margin area on the leading edge side of the subsequent sheet (the (x+1)-th sheet) about one round of the fixing belt 100.

The margin area is an area in which a toner image is not formed by the image forming apparatus 1 regardless of a content of the image information to be formed on the sheet P. The margin area is set in advance in the image forming apparatus 1. The margin area on the leading edge side is a margin area placed on the leading edge side than the image area in the conveyance direction of the sheet P. In FIG. 9, the margin area on the leading edge side (a leading edge margin) in the subsequent sheet (the (x+1)-th sheet) is indicated as a hatched portion. Further, the image area is an area in which the toner image can be formed by the image forming apparatus 1.

The present inventors studied by forming halftone images in which an image streak tends to be apparent in the image areas. CS-680 manufactured by CANON Inc. was used as the sheet P. In the sheet interval in the normal mode, when the separation discharge occurred between a trailing edge of the x-th sheet P and the fixing belt 100, appearance of the image streak due to the separation discharge mark was confirmed in the image area of the (x+1)-th sheet P. On the other hand, in the sheet interval in the countermeasure mode, when the separation discharge occurred between the trailing edge of the x-th sheet P and the fixing belt 100, the image streak due to the separation discharge mark was not visually recognized in the image area of the (x+1)-th sheet P.

Therefore, when the sheet interval is extended than the normal mode, and the portion at which the separation discharge occurred is brought into contact with the margin area on the leading edge side of the subsequent sheet before the portion at which the separation discharge occurred is brought into contact with the image area of the subsequent sheet, the image streak can be restrained from becoming apparent in the image area of the subsequent sheet.

When the separation discharge occurs between the trailing edge of the x-th sheet P and the fixing belt 100, and the fixing belt 100 is idled to resolve the separation discharge mark and then brought into contact with the image area of the (x+1)-th sheet P, idling requires about 120 seconds. In contrast, in the case of the countermeasure mode in which the portion at which the separation discharge occurred is brought into contact with the margin area on the leading edge side of the subsequent sheet, the separation discharge mark can be resolved by the sheet interval time corresponding to one round of the circumferential length of the fixing belt 100. According to the configuration of the present embodiment, it takes about 304 (ms) for the fixing belt 100 to rotate one round. Therefore, the portion at which the separation discharge occurred is brought into contact with the margin area on the leading edge side of the subsequent sheet as in the countermeasure mode, and thus the image streak can be restrained from becoming apparent in the image area of the subsequent sheet while restraining remarkable lowering of the productivity.

Thus, the image forming apparatus 1 executes the countermeasure mode in which the sheet interval is extended with respect to the normal mode, and the sheet P is conveyed at the sheet interval in which the portion at which the separation discharge occurred is brought into contact with the margin area on the leading edge side of the subsequent sheet before being brought into contact with the image area of the subsequent sheet and thus restrains the image streak from becoming apparent. Accordingly, the image forming apparatus 1 can cope with needs of a user who places emphasis on an image quality than the productivity.

The image streak due to the separation discharge becomes more remarkably apparent in a halftone image but does not become apparent in all of users' resultant products. For example, for a user who mainly prints an image of a document, the image streak due to the separation discharge often cannot be visually recognized or is in a degree not annoying even it is visually recognized. For such a user, it is required not to reduce the productivity than to take a countermeasure against the image streak by reducing the productivity. Therefore, the image forming apparatus 1 executes the normal mode placing emphasis on the productivity to cope with the needs of the user who places emphasis on the productivity than the image quality.

In FIG. 9, the example is described in which the sheet interval in the normal mode is less than one round of the circumferential length of the fixing belt 100 in a distance, however, the sheet interval in the normal mode may be appropriately set according to the configuration of the apparatus. In other words, the sheet interval in the normal mode may be one round of the circumferential length of the fixing belt 100 or more in a distance. In this case, the sheet interval time P1 of the normal mode is longer than a time required for the fixing belt 100 to rotate one round. Even in this case, the sheet interval in the countermeasure mode is set to the sheet interval which is longer than that of the normal mode and in which the portion at which the separation discharge occurred is brought into contact with the margin area on the leading edge side of the subsequent sheet before the portion at which the separation discharge occurred is brought into contact with the image area of the subsequent sheet.

Further, in FIG. 9, the sheet interval in the countermeasure mode is longer than the sheet interval in the normal mode and the minimum sheet interval in which the portion at which the separation discharge occurred is brought into contact with the margin area on the leading edge side of the subsequent sheet before the portion at which the separation discharge occurred is brought into contact with the image area of the subsequent sheet, however, the sheet interval is not limited thereto. The sheet interval in the countermeasure mode may be set to a sheet interval which is longer than that of the normal mode and in which the portion at which the separation discharge occurred is brought into contact with the margin area on the leading edge side of the subsequent sheet before the portion at which the separation discharge occurred is brought into contact with the image area of the subsequent sheet. For example, in FIG. 9, the sheet interval in the countermeasure mode may be set to a sheet interval in which the portion brought into contact with the trailing edge portion of the preceding sheet (the x-th sheet) on the circumference surface of the fixing belt 100 is brought into contact with the margin area on the leading edge side of the subsequent sheet (the (x+1)-th sheet) after two rounds of the fixing belt 100. However, a shorter sheet interval may be set in order to restrain the reduction of the productivity with respect to the normal mode as small as possible.

<Setting of Countermeasure Mode>

According to the image forming apparatus 1, the operator can set one mode from among a plurality of modes including the normal mode placing emphasis on the productivity and the countermeasure mode placing emphasis on the image quality on the display unit 180B in the operation unit 180 in response to the needs of the user.

Figure 10:
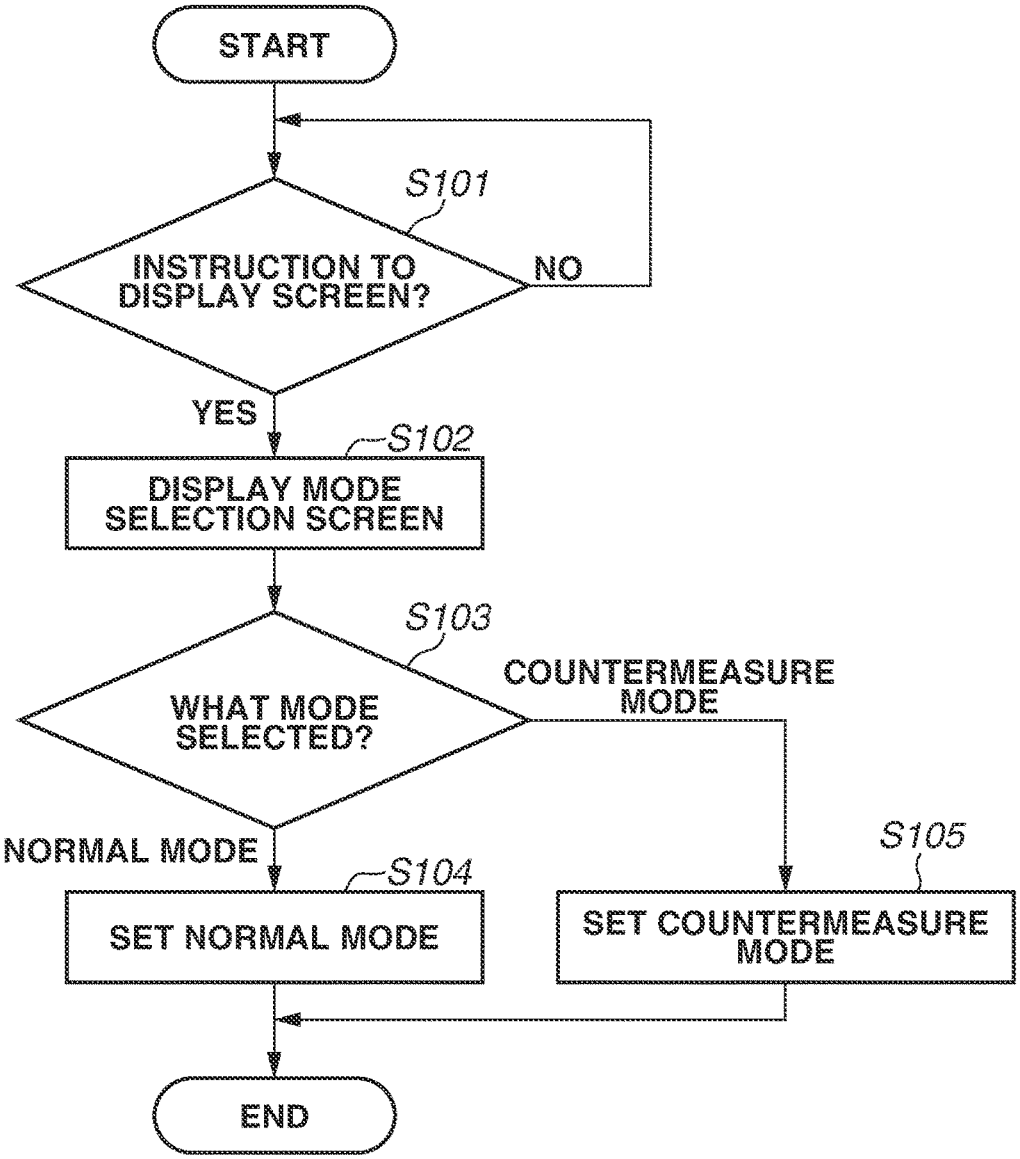
FIG. 10 is a flowchart regarding the mode setting.
Figure 13:
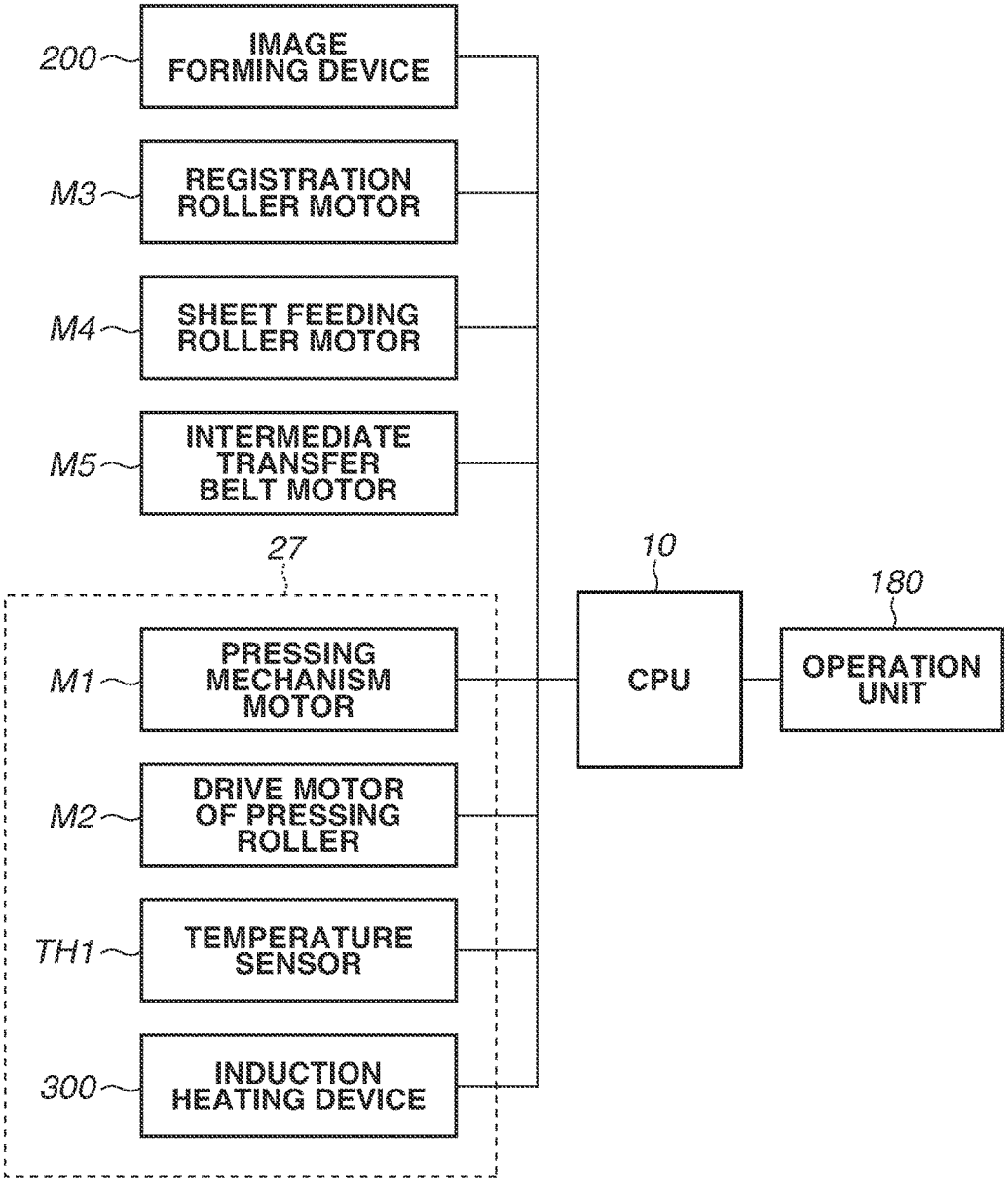
FIG. 13 is a block diagram illustrating an example of a configuration of a control system.

A control flow for setting the mode is described with reference to a flowchart illustrated in FIG. 10 and a block diagram illustrated in FIG. 13. The control illustrated in the flowchart is performed by the CPU 10 functioning as an execution unit (a controller) executing a control program stored in a built-in storage unit. FIG. 10 is the flowchart regarding the mode setting, and FIG. 13 is a block diagram illustrating an example of a configuration of a control system. The CPU 10 is electrically connected to the operation unit 180.

The storage unit is not limited to the one built in the CPU 10, and a memory which is separated from and electrically connected to the CPU 10 is provided in the image forming apparatus 1 and may be configured to function as a storage unit for storing a program and data.

In step S101, when the operator inputs an instruction to display a mode selection screen to the operation unit 180 (YES in step S101), then in step S102, the CPU 10 displays the mode selection screen on the display unit 180B in the operation unit 180. Specifically, the CPU 10 displays a soft key 180C of the "normal mode" and a soft key 180D of the "countermeasure mode" on the display unit 180B as illustrated in FIG. 11. FIG. 11 illustrates an example of the mode selection screen.

In step S103, when the soft key 180C of the "normal mode" is pressed on the mode selection screen (i.e., the selected mode is the "normal mode"), then in step S104, the CPU 10 sets the normal mode placing emphasis on the productivity. In step S103, when the soft key 180D of the "countermeasure mode" is pressed on the mode selection screen (i.e., the selected mode is the "countermeasure mode"), then in step S105, the CPU 10 sets the countermeasure mode placing emphasis on the image quality. Thus, the image formation processing is executed according to the mode. The CPU 10 stores information corresponding to the set mode in the storage unit built in the CPU 10.

Accordingly, the user can select the mode to be executed by the image forming apparatus 1 according to the needs of himself/herself.

According to the present embodiment, the operator inputs an instruction to display the mode selection screen using the operation unit 180, and thus the mode can be selected or changed in the image forming apparatus 1. Once the mode is set, the mode executed by the CPU 10 is not changed unless the operator changes the selected mode on the mode selection screen. Accordingly, once the mode is set, the operator does not need to repeat the mode setting unless necessary.

In this regard, the normal mode may be set as an initial setting. In this case, when the operator does not input an instruction to display the mode selection screen, the CPU 10 executes the normal mode. Further, the operator can change the setting from the initial setting on the mode selection screen.

According to the present embodiment, the example is described in which options of the modes include two of the normal mode placing emphasis on the productivity and the countermeasure mode placing emphasis on the image quality, however, other modes may be provided as modes which can be set in the image forming apparatus 1. Further, according to the present embodiment, the mode is selected by pressing the soft key, however, the mode may be selected using the operation button unit 180A.

<Execution of Image Formation Processing Corresponding to Mode>

Figure 12:
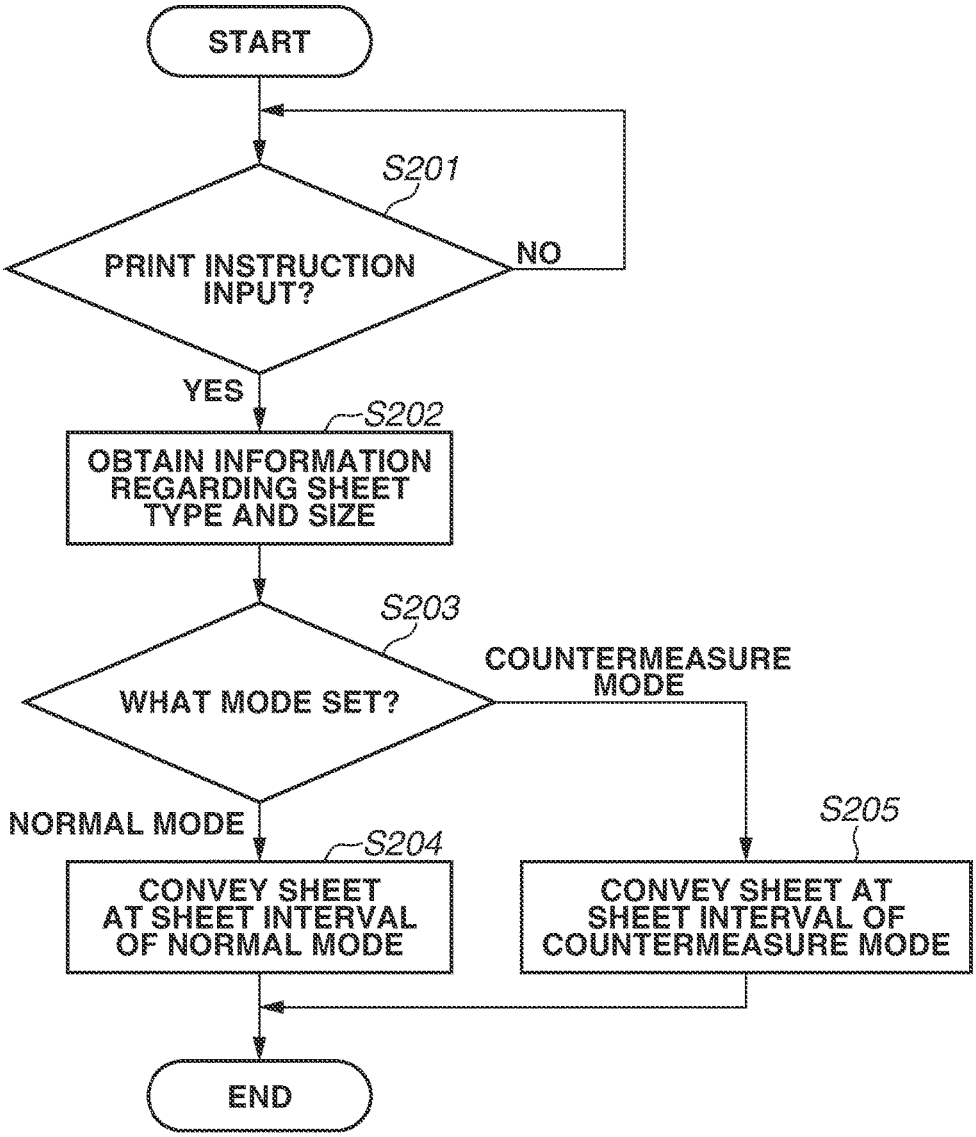
FIG. 12 is a flowchart regarding control corresponding to a mode.

Next, execution of the image formation processing corresponding to the mode is described with reference to a flowchart illustrated in FIG. 12 and the block diagram illustrated in FIG. 13. FIG. 12 is the flowchart regarding the control corresponding to the mode. The control illustrated in the flowchart is performed by the CPU 10 functioning as the execution unit (the controller) executing a control program stored in the built-in storage unit. The CPU 10 is electrically connected to the image forming device 200 as illustrated in FIG. 13 and controls an image formation operation by the image forming device 200. Further, the CPU 10 is connected to a registration roller motor M3, a sheet feeding roller motor M4, an intermediate transfer belt motor M5, and the fixing device and controls the image formation operation, a fixing operation, and conveyance of the sheet P.

When the image forming apparatus 1 receives an energization command (for example, turning on of a power source switch), the CPU 10 shifts to start-up control and then enters a state waiting for input of a print command. The print command is a command to the image forming device 200 to execute the image formation processing. The print command is, for example, an instruction to start printing input by the operator from the operation unit 180 or the external personal computer and an instruction to start copying input by the operator from the operation unit 180.

In step S201, when the print command is input in the state for waiting the input of the print command (YES in step S201), then in step S202, the CPU 10 obtains sheet information including information pieces corresponding to a size, a basis weight, and a type of the sheet material of the sheet P on which the toner image is formed by the print command. These information pieces are input from the operation unit 180 or the external personal computer as the instruction by the operator. According to the present embodiment, a case is described as an example in which the image formation processing to be executed with respect to the input print command is to continuously perform the image formation on a plurality of the predetermined sheets P (i.e., the sheets P having the predetermined size and the predetermined type). The plurality of the sheets P described as the example here has the same size and the same type with each other (i.e., the sheets having the same size, the same basis weight, and the same material). An example is a case when printing is performed on ten sheets of the A4 size plain paper.

Next, in step S203, the CPU 10 refers the storage unit and determines the mode set to the image forming apparatus 1. The mode setting is as described above.

The CPU 10 executes the set mode. In other words, the CPU 10 selectively executes the set mode from among the plurality of modes including the normal mode placing emphasis on the productivity and the countermeasure mode placing emphasis on the image quality.

When the set mode is the "normal mode", then in step S204, the CPU 10 conveys the sheet P to the fixing nip portion N so that the sheet interval time becomes the time P1 prioritizing the productivity.

The sheet interval time P1 is determined based on the sheet information obtained in step S202. For example, a table in which the sheet information is associated with the sheet interval time P1 is stored in advance in the storage unit, and the CPU 10 determines the sheet interval time P1 by referring to the table based on the information obtained in step S202. The sheet interval time is, as described above, a time length from when the trailing edge of the preceding sheet (the x-th sheet) passes through the fixing nip portion N to when the leading edge of the subsequent sheet (the (x+1)-th sheet) conveyed to the fixing nip portion N next to the preceding sheet passes through the fixing nip portion N.

On the other hand, when the set mode is the "countermeasure mode", then in step S205, the CPU 10 conveys the sheet P to the fixing nip portion N so that the sheet interval time becomes the above-described time P2 prioritizing the image quality. The sheet interval time P2 for the countermeasure mode is, as described above, the sheet interval time set so that the portion brought into contact with the trailing edge portion of the preceding sheet on the circumference surface of the fixing belt 100 comes into the margin area on the leading edge side of the subsequent sheet. The sheet interval time P2 is determined based on the sheet information obtained in step S202. For example, a table in which the sheet information is associated with the sheet interval time P2 is stored in advance in the storage unit, and the CPU 10 determines the sheet interval time P2 by referring to the table based on the information obtained in step S202.

The conveyance of the sheet P is described in more detail. According to the present embodiment, the CPU 10 controls the motor M3 of the registration roller 33 to change a time to stop the sheet P next to the preceding sheet at the registration roller 33 in the normal mode and in the countermeasure mode, and thus adjusts the sheet interval time. When the image formation is performed in the same conditions, a rotation speed of the pressing roller 600 is the same in the normal mode and the countermeasure mode.

Specifically, the CPU 10 drives the sheet feeding roller motor M4 of a sheet feeding cassette (the cassette 31 here) storing the sheet P on which the toner image is formed with respect to the print command input in step S201. Accordingly, the CPU 10 feeds the first sheet P for the print command input in step S201 to the sheet feeding roller 32 from the cassette 31. The fed first sheet P is conveyed to the registration roller 33.

The CPU 10 also causes the image forming device 200, the intermediate transfer belt motor M5, and the fixing device 27 to start operations. The CPU 10 causes the image forming device 200 to form an image to be transferred to the first sheet P. The CPU 10 causes the registration roller 33 to feed out the sheet P to the transfer nip portion in accordance with a timing at which the toner image corresponding to the first sheet P on the intermediate transfer belt 25 reaches the transfer nip portion.

When the registration roller 33 completes feeding out of the first sheet P, the CPU 10 stops the second sheet P at the registration roller 33. The image forming device 200 forms an image to be transferred to the second sheet P with a predetermined sheet interval following the image to be transferred to the first sheet P. The CPU 10 causes the image forming device 200 to form the toner images on the intermediate transfer belt 25 so that an interval between the toner image to be transferred to the first sheet and the toner image to be transferred to the second sheet becomes an interval corresponding to the sheet interval time corresponding to the mode. The sheet interval time corresponding to the mode is the sheet interval time P1 in the normal mode and the sheet interval time P2 in the countermeasure mode.

The CPU 10 controls the registration roller motor M3 to feed out the sheet P in accordance with a timing at which the toner image on the intermediate transfer belt 25 corresponding to the second sheet P which is formed with an image interval based on the sheet interval time corresponding to the mode reaches the transfer nip portion. In other words, the CPU 10 stops the second sheet P at the registration roller 33 until the sheet interval time P1 to the first sheet P has elapsed in the case of the normal mode and stops the second sheet P at the registration roller 33 until the sheet interval time P2 to the first sheet P has elapsed in the case of the countermeasure mode. The sheet interval time is, as described above, a time length from when the trailing edge of the preceding sheet passes through the fixing nip portion N to when the leading edge of the subsequent sheet conveyed to the fixing nip portion N next to the preceding sheet passes through the fixing nip portion N.

In other words, the sheet interval time between the preceding sheet and the subsequent sheet at the fixing nip portion N is adjusted by the time during which the sheet is stopped at the registration roller 33.

When the time to be stopped at the registration roller 33 has elapsed, the CPU 10 drives the registration roller motor M3 to rotate the registration roller 33 and starts the conveyance of the second sheet P. The second sheet P passing through the transfer nip portion passes through the fixing nip portion N at the sheet interval time P1 to the first sheet P in the case of the normal mode and passes through the fixing nip portion N at the sheet interval time P2 to the first sheet P in the case of the countermeasure mode.

Regarding the conveyance of the third sheet P, the CPU 10 similarly controls the conveyance of the third sheet P so that the sheet interval time to the second sheet P becomes the sheet interval time corresponding to the mode. The processing is similarly performed until the last sheet P corresponding to the input print command is conveyed.

As described above, the registration roller 33 feeds out the sheet P in accordance with a timing at which the toner image on the intermediate transfer belt 25 corresponding to the subsequent sheet P reaches the transfer nip portion and realizes the conveyance of the sheet P at the sheet interval determined based on the sheet information.

Here, a setting value of the sheet interval time when an A4 size sheet P passes through is described as an example in each mode. According to the present embodiment, an outer diameter of the fixing belt 100 is 30 mm, a circumferential length is approximately 94 mm, and a size of a margin portion is 3.5 mm. These values are examples, and the present embodiment is not limited to them. In addition, a length of the A4 size sheet P in the conveyance direction is approximately 210 mm.

The sheet interval in the normal mode placing emphasis on the productivity according to the present embodiment is approximately 30 mm in a distance. The sheet interval time P1 can be calculated by dividing the sheet interval by a rotation speed of the fixing belt 100 determined based on the sheet type. The sheet interval in the normal mode is a value determined by the productivity of the image forming apparatus 1 and set in advance for each sheet type and each sheet size. According to the present embodiment, the circumferential length of the fixing belt 100 is approximately 210 mm, and as illustrated in FIG. 9, the sheet interval in the normal mode is less than one round of the circumferential length of the fixing belt 100 in a distance.

Next, a setting of the sheet interval time in the countermeasure mode is described. In order to bring the portion brought into contact with the trailing edge of the preceding sheet on the fixing belt 100 into contact with the inside of the margin area on the leading edge side of the subsequent sheet, a target sheet interval is set here based on a position at which the portion brought into contact with the trailing edge of the preceding sheet is brought into contact with a center portion of the margin area on the leading edge side of the sheet P in the conveyance direction. In other words, the target sheet interval is an interval obtained by adding a value dividing a length of the margin portion by two to the length of one round of the fixing belt. When an outer diameter of the fixing belt 100 is 30 mm, the circumferential length is approximately 94 mm, and the size of the margin portion is 3.5 mm, the target sheet interval is approximately 92.5 mm. When the target sheet interval is divided by the rotation speed of the fixing belt 100 determined by the sheet type, the sheet interval time P2 can be calculated.

The storage unit in the image forming apparatus 1 stores in advance a value of the sheet interval time of each mode calculated as described above, and the CPU 10 controls the conveyance of the sheet P by the sheet interval time corresponding to the set mode. When the set mode is the countermeasure mode, the CPU 10 may calculate the sheet interval time in the countermeasure mode as described above according to the obtained sheet information.

Accordingly, in the countermeasure mode, the sheet interval is adjusted so that the portion brought into contact with the trailing edge portion of the preceding sheet P comes into the margin area of the subsequent sheet. In other words, when the countermeasure mode is executed, the image forming apparatus 1 brings the portion at which the separation discharge occurred into contact with the margin area on the leading edge side of the (x+1)-th sheet before bringing it into contact with the image area of the (x+1)-th sheet even when the separation discharge mark is generated on the fixing belt 100 by the trailing edge portion of the x-th sheet P. Accordingly, the separation discharge mark on the fixing belt 100 can be relieved, and the image streak can be restrained from becoming apparent in the image area of the (x+1)-th sheet.

According to the present embodiment, the case in which the A4 size sheet P is used is described as a specific example for continuously performing the image formation on a plurality of the sheets P, however, the size of the sheet P is not limited to the A4 size. Even when the sheet P having a maximum width size (a size in a direction perpendicular to the conveyance direction) which can be conveyed by the image forming apparatus 1 is used as a predetermined type of the sheet P in the continuous image formation for a plurality of the sheets, the image forming apparatus 1 according to the present embodiment conveys the sheet P at the sheet interval time corresponding to the mode. In other words, in the normal mode, the CPU 10 controls the conveyance of the sheet P so that the sheet interval time prioritizing the productivity is attained. In the countermeasure mode, the CPU 10 controls the conveyance of the sheet P so that the sheet interval time is the one in which the portion brought into contact with the trailing edge portion of the preceding sheet (the x-th sheet) on the circumference surface of the fixing belt 100 is brought into contact with the inside of the margin area on the leading edge side of the subsequent sheet (the (x+1)-th sheet). However, values of the sheet interval times P1 and P2 may be different from that in the case when the A4 size sheet P is used.

Further, the image forming apparatus 1 may be configured to convey the sheet P at the sheet interval time corresponding to the mode even when the image formation is performed on a plurality of sheets in which different size, such as A3, B5, and A3 size sheets P are mixed. In other words, in the normal mode, the CPU 10 controls the conveyance of the sheet P so that the sheet interval time prioritizing the productivity is attained. In the countermeasure mode, the CPU 10 controls the conveyance of the sheet P so that the sheet interval time is the one in which the portion brought into contact with the trailing edge portion of the preceding sheet (the x-th sheet) on the circumference surface of the fixing belt 100 is brought into contact with the inside of the margin area on the leading edge side of the subsequent sheet (the (x+1)-th sheet). In this case, specific values of the sheet interval times P1 and P2 may be different in each size of the sheet P.

According to the present embodiment, the sheet interval time corresponding to the mode is adjusted by the CPU 10 controlling a timing of driving and stopping the registration roller 33, however, a method for adjusting the sheet interval time is not limited thereto. For example, the CPU 10 may control a timing that the sheet feeding roller 32 feeds out the sheet P in accordance with the sheet interval time corresponding to the mode.

According to the present embodiment, the sheets P are conveyed at a constant sheet interval time (the time P1 in the normal mode, and the time P2 in the countermeasure mode) from the first sheet to the last sheet P corresponding to the input print command in the image formation corresponding to the input print command. However, when the image formation processing is interrupted due to, for example, occurrence of a jam and occurrence of an abnormal temperature rise in a member, the sheet interval time before and after the interruption may not be the sheet interval time corresponding to the set mode as an exception. For example, when a jam occurs in the countermeasure mode, and if the sheet interval time between the x-th sheet P immediately before the occurrence of the jam and the (x+1)-th sheet P immediately after the occurrence of the jam does not satisfy the sheet interval time for the countermeasure mode, it is regarded as the configuration within the scope of the present embodiment.

A case when the image formation processing is interrupted is not limited to occurrence of abnormality such as occurrence of a jam and occurrence of an abnormal temperature rise in a member. For example, a case is included in which the image formation processing is temporarily interrupted by processing which is regularly executed by interrupting the sheet interval such as calibration processing of the image forming device. In this case also, the sheet interval time before and after the interruption by the interrupting processing does not have to be the sheet interval time corresponding to the set mode as an exception.

As described above, the image forming apparatus 1 allows the operator to set one mode from among the plurality of modes including the normal mode placing emphasis on the productivity and the countermeasure mode placing emphasis on the image quality on the display unit 180B in the operation unit 180 in response to the needs of the user. Accordingly, the user can select the mode to be executed by the image forming apparatus 1 according to the needs of himself/herself.

As described above, the image forming apparatus 1 executes the normal mode when the normal mode is set and conveys the sheet P to the fixing nip portion N so that the sheet interval time P1 prioritizing the productivity is attained. Accordingly, the image forming apparatus 1 can cope with the needs of the user who places emphasis on the productivity than the image quality.

Further, as described above, the image forming apparatus 1 executes the countermeasure mode when the countermeasure mode is set. In other words, when the countermeasure mode is set, the image forming apparatus 1 conveys the sheet P to the fixing nip portion N so that the sheet interval time P2 is attained in which the portion brought into contact with the trailing edge portion of the preceding sheet (the x-th sheet) on the circumference surface of the fixing belt 100 is brought into contact with the inside of the margin area on the leading edge side of the subsequent sheet (the (x+1)-th sheet). Accordingly, the image forming apparatus 1 can restrain the image streak from becoming apparent and cope with the needs of the user who places emphasis on the image quality than the productivity.

Therefore, the image forming apparatus can be provided which can cope with the needs of the both of the user who places emphasis on the productivity and the user who places emphasis on the image quality.

According to the configuration of the first embodiment, the CPU 10 executes the mode selected by the operator from among the plurality of the modes including the normal mode and the countermeasure mode.

On the other hand, according to a second embodiment, a configuration is described in which the CPU 10 automatically controls the sheet interval of the sheet P according to an environment in which the image forming apparatus 1 is disposed. In the following description, members having the configurations similar to those in the first embodiment are denoted by the same reference numerals, and thus the detail descriptions thereof are omitted.

Figure 14:
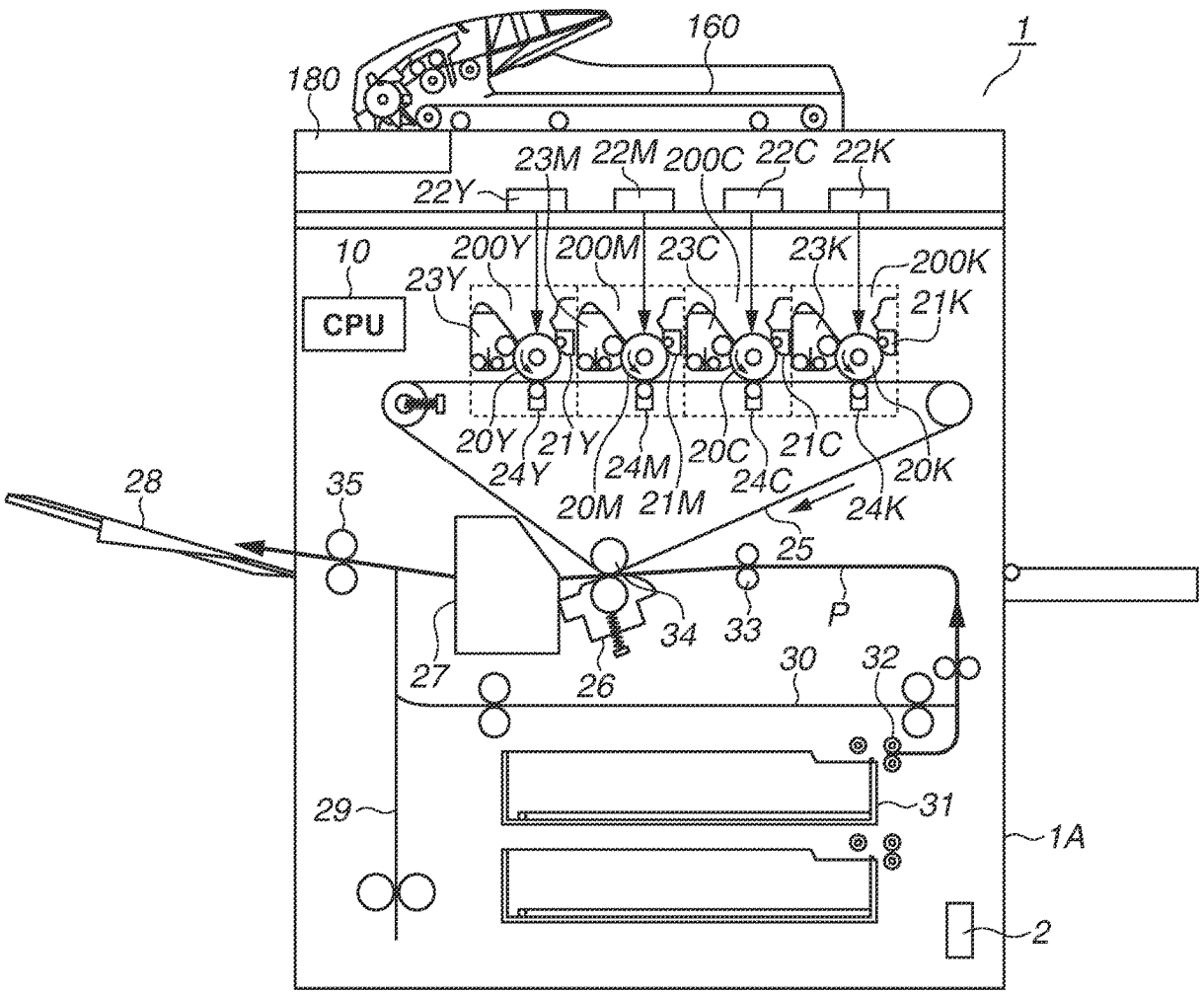
FIG. 14 illustrates an example of the image forming apparatus.

FIG. 14 illustrates an example of the image forming apparatus.

The image forming apparatus 1 according to the present embodiment (FIG. 14) includes an environmental sensor 2. This point is different from the image forming apparatus 1 according to the first embodiment (FIG. 1).

The environmental sensor 2 is a sensor installed inside the main body 1A of the image forming apparatus 1. The environmental sensor 2 functions as a detection unit for detecting a temperature and humidity (relative humidity) of atmosphere of an installation location. A temperature and/or humidity detected by the environmental sensor 2 can vary by being affected by a temperature and/or humidity of a surrounding environment (the outside of the main body LA) in which the apparatus is disposed. A detection result of the environmental sensor 2 is used for detecting a water content in the air which is described below.

Regarding the image forming apparatus 1, the other configurations are similar to those of the image forming apparatus 1 according to the first embodiment (FIG. 1), and thus the detail descriptions thereof are omitted.

<Generation of Separation Discharge Mark>

As described above in the first embodiment with reference to FIGS. 7 and 8, when the sheet P passes through the fixing nip portion N, the separation discharge may occur between the fixing belt 100 and the trailing edge of the sheet P in some cases. When the separation discharge occurs, a potential becomes higher (to a plus side) at a position where the separation discharge occurred on the fixing belt 100 than the periphery thereof as the separation discharge mark. When the position of the fixing belt 100 at which the separation discharge occurred is brought into contact with the unfixed toner image on the next sheet P, the toner image on the sheet P may be disturbed and becomes apparent as an image streak.

Especially, when the image forming apparatus 1 is under a low humidity environment, the discharge (the separation discharge) tends to occur between the fixing belt 100 and the trailing edge of the sheet P. Under the low humidity environment, an electric charge of the surface of the fixing belt 100 is hardly leaked into the air compared to a high humidity environment, and thus the surface potential of the fixing belt 100 tends to be larger in the negative polarity side (i.e., the potential becomes lower) according to the frictional charge and/or the separation charge. In other words, the potential difference between the fixing belt 100 and the sheet P is likely to be larger, and the separation discharge tends to occur.

The low humidity environment refers to an environment of which the water content in the air is less than a predetermined water content. The water content in the air is an amount expressed by a mass of moisture (water vapor) contained in 1 kg of the air and determined based on the temperature and the relative humidity inside the image forming apparatus 1 detected by the environmental sensor 2.

The CPU 10 and the environmental sensor 2 function as a detection unit for detecting the water content in the air. For example, the CPU 10 refers to a correspondence table stored in the built-in storage unit and determines the water content in the air from the temperature and the relative humidity detected by the environmental sensor 2.

A value of a predetermined water content to be a reference of the low humidity environment may be appropriately set according to the configuration of the image forming apparatus 1. According to the present embodiment, the predetermined water content is 5.0 (g/kg), and the low humidity environment refers to an environment of which the water content in the air is less than 5.0 (g/kg).

The water content in the air may be regarded as a mass of moisture (water vapor) contained in 1 kg of the air excluding moisture (water vapor). In other words, according to the present embodiment, the CPU 10 uses a value expressed by the mass of moisture (water vapor) contained in 1 kg of the air as a determination criterion of the low humidity environment, however, a value indicating similar information may be used as the determination criterion.

<Appearance of Image Streak by Separation Discharge Mark>

The present inventors studied and found that when the portion at which the separation discharge occurred is brought into contact with the margin area of the sheet P before being brought into contact with the image area of the subsequent sheet, the image streak can be restrained from becoming apparent in the image area of the subsequent sheet.

Figure 15:
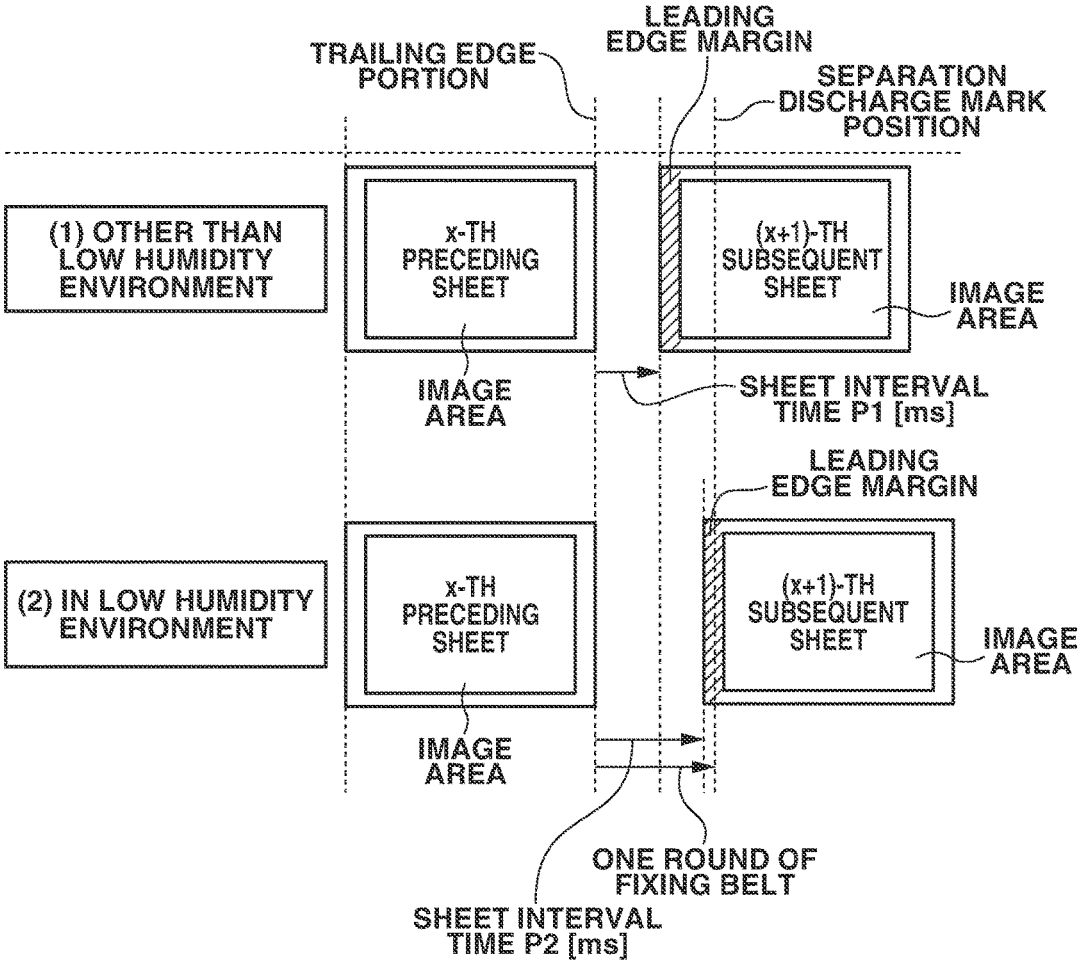
FIG. 15 illustrates a sheet interval under each environment.

FIG. 15 illustrates the sheet interval under each environment. Specifically, FIG. 15 illustrates a comparison of (1) the sheet interval of a case other than the low humidity environment and (2) the sheet interval of a case in the low humidity environment (the sheet interval for a countermeasure against the image defect due to the separation discharge mark). A case is described below as an example in which the image formation is continuously performed on a plurality of the predetermined sheets P (i.e., the sheet P having the predetermined size and the predetermined type). The plurality of the sheets P described as the example here has the same size and the same type with each other (i.e., the sheets having the same size, the same basis weight, and the same material). An example is a case when printing is performed on ten sheets of the A4 size plain paper.

In FIG. 15, the sheet interval time P1 (ms) is for the normal sheet interval, and the portion abutted on the trailing edge of the preceding sheet (the x-th sheet) on the circumference surface of the fixing belt 100 comes into the image area of the subsequent sheet (the (x+1)-th sheet). More specifically, the portion abutted on the trailing edge of the preceding sheet (the x-th sheet) on the circumference surface of the fixing belt 100 is brought into contact with the image area of the subsequent sheet (the (x+1)-th sheet) without being brought into contact with the margin area on the leading edge side of the subsequent sheet (the (x+1)-th sheet). In the case other than the low humidity environment, the sheet interval time is the sheet interval time P1 (ms) as the normal sheet interval.

The sheet interval time is a time length (a period) from when the trailing edge of the preceding sheet (the x-th sheet) passes through the fixing nip portion N to when the leading edge of the subsequent sheet (the (x+1)-th sheet) conveyed to the fixing nip portion N next to the preceding sheet passes through the fixing nip portion N. FIG. 15 illustrates a case when the sheet interval is less than one round of the fixing belt 100 in a distance.

In FIG. 15, the sheet interval time P2 (ms) is the sheet interval for the countermeasure against the image defect due to the separation discharge mark (hereinbelow, referred to as the sheet interval of the countermeasure against the separation discharge mark), and the productivity of which is reduced compared to that of the normal sheet interval. In other words, P2>P1. In the normal sheet interval (the sheet interval time P1), the portion brought into contact with the trailing edge portion of the preceding sheet (the x-th sheet) on the circumference surface of the fixing belt 100 is brought into contact with the margin area on the leading edge side of the subsequent sheet (the (x+1)-th sheet). On the other hand, in the sheet interval of the countermeasure against the separation discharge mark (the sheet interval time P2) is set to a time length calculated from the circumferential length of the fixing belt 100 so that the portion brought into contact with the trailing edge portion of the preceding sheet on the circumference surface of the fixing belt 100 comes into the margin area of the subsequent sheet. The sheet interval in the low humidity environment is the sheet interval of the countermeasure against the separation discharge mark (the sheet interval time P2). FIG. 15 illustrates a case when the sheet interval of the countermeasure against the separation discharge mark is the sheet interval in which the portion brought into contact with the trailing edge portion of the preceding sheet (the x-th sheet) on the circumference surface of the fixing belt 100 is brought into contact with the margin area on the leading edge side of the subsequent sheet (the (x+1)-th sheet) about one round of the fixing belt 100.

The margin area is an area in which a toner image is not formed by the image forming apparatus 1 regardless of a content of the image information to be formed on the sheet P. The margin area is set in advance in the image forming apparatus 1. The margin area on the leading edge side is a margin area placed on the leading edge side than the image area in the conveyance direction of the sheet P. In FIG. 15, the margin area on the leading edge side (the leading edge margin) in the subsequent sheet (the (x+1)-th sheet) is indicated as a hatched portion. Further, the image area is an area in which the toner image can be formed by the image forming apparatus 1.

The present inventors studied by forming halftone images in which an image streak tends to be apparent in the image areas. CS-680 manufactured by CANON Inc. was used as the sheet P. When the sheet P was conveyed at the normal sheet interval under the low humidity environment, and the separation discharge occurred between the trailing edge of the x-th sheet P and the fixing belt 100, appearance of the image streak due to the separation discharge mark was confirmed in the image area of the (x+1)-th sheet P. On the other hand, in the sheet interval of the countermeasure against the separation discharge mark, when the separation discharge occurred between the trailing edge of the x-th sheet P and the fixing belt 100, the portion brought into contact with the trailing edge of the x-th sheet on the circumference surface of the fixing belt 100 was brought into contact with the margin area on the leading edge side of the (x+1)-th sheet and then brought into contact with the image area of the (x+1)-th sheet P. However, in the image area of the (x+1)-th sheet P, the image streak due to the separation discharge mark was not visually recognized.

Therefore, when the sheet interval is extended than the normal one, and the portion at which the separation discharge occurred is brought into contact with the margin area on the leading edge side of the subsequent sheet before the portion at which the separation discharge occurred is brought into contact with the image area of the subsequent sheet, the image streak can be restrained from becoming apparent in the image area of the subsequent sheet.

When the separation discharge occurs between the trailing edge of the x-th sheet P and the fixing belt 100, and the fixing belt 100 is idled to resolve the separation discharge mark and then brought into contact with the image area of the (x+1)-th sheet P, idling requires about 120 seconds. In contrast, as in the sheet interval of the countermeasure against the separation discharge mark (the sheet interval time P2), when the portion at which the separation discharge occurred is brought into contact with the margin area on the leading edge side of the subsequent sheet, the separation discharge mark can be resolved by the sheet interval time of about the one round of the circumferential length of the fixing belt 100. According to the configuration of the present embodiment, it takes about 304 (ms) for the fixing belt 100 to rotate one round. Therefore, when the portion at which the separation discharge occurred is brought into contact with the margin area on the leading edge side of the subsequent sheet as in the sheet interval of the countermeasure against the separation discharge mark (the sheet interval time P2) under the low humidity environment, the image streak can be restrained from becoming apparent in the image area of the subsequent sheet.

Thus, the image forming apparatus 1 extends the sheet interval under the low humidity environment in which the separation discharge mark tends to be generated and conveys the sheet P at the sheet interval of the countermeasure against the separation discharge mark in which the portion at which the separation discharge occurred is brought into contact with the margin area on the leading edge side of the subsequent sheet before being brought into contact with the image area of the subsequent sheet. In other words, the image quality is prioritized under the low humidity environment in which the separation discharge mark tends to be generated. Accordingly, the image streak can be restrained from becoming apparent.

Further, the image forming apparatus 1 conveys the sheet P at the normal sheet interval which is narrower than the sheet interval of the countermeasure against the separation discharge mark so as to prioritize the productivity under an environment other than the low humidity environment (e.g., an environment of which the water content in the air is 5.0 (g/kg) or more) in which the separation discharge mark does not tend to be generated. Accordingly, the image forming apparatus 1 can restrain the image streak due to the separation discharge on the fixing device from becoming apparent under the low humidity environment and also can restrain the productivity from being reduced under the environment other than the low humidity environment.

In FIG. 15, the example is described in which the sheet interval in the normal time is less than one round of the circumferential length of the fixing belt 100 in a distance, however, the sheet interval in the normal time may be appropriately set according to the configuration of the apparatus. In other words, the sheet interval in the normal time may be one round of the circumferential length of the fixing belt 100 or more in a distance. In this case, the sheet interval time P1 is longer than a time required for the fixing belt 100 to rotate one round. The sheet interval in the normal time (the sheet interval time P1) may be set to the sheet interval prioritizing the productivity. Thus, even when the sheet interval in the normal time is set to a time longer than a time required for the fixing belt 100 to rotate one round, the sheet interval of the countermeasure against the separation discharge mark cannot be set shorter than the normal sheet interval prioritizing the productivity and thus is set to a longer sheet interval. In other words, the sheet interval of the countermeasure against the separation discharge mark is set to a sheet interval which is longer than the normal sheet interval and in which the portion at which the separation discharge occurred is brought into contact with the margin area on the leading edge side of the subsequent sheet before the portion at which the separation discharge occurred is brought into contact with the image area of the subsequent sheet.

Further, in FIG. 15, the sheet interval of the countermeasure against the separation discharge mark is longer than the normal sheet interval and the minimum sheet interval in which the portion at which the separation discharge occurred is brought into contact with the margin area on the leading edge side of the subsequent sheet before the portion at which the separation discharge occurred is brought into contact with the image area of the subsequent sheet, however, the sheet interval is not limited thereto. The sheet interval of the countermeasure against the separation discharge mark may be set to a sheet interval which is longer than the normal sheet interval and in which the portion at which the separation discharge occurred is brought into contact with the margin area on the leading edge side of the subsequent sheet before the portion at which the separation discharge occurred is brought into contact with the image area of the subsequent sheet. For example, in FIG. 15, the sheet interval of the countermeasure against the separation discharge mark may be a sheet interval in which the portion brought into contact with the trailing edge portion of the preceding sheet (the x-th sheet) on the circumference surface of the fixing belt 100 is brought into contact with the margin area on the leading edge side of the subsequent sheet (the (x+1)-th sheet) after two rounds of the fixing belt 100. However, the shorter sheet interval may be set in order to restrain the reduction of the productivity as small as possible.

<Execution of Image Formation Processing Corresponding to Environment>

Figure 16:
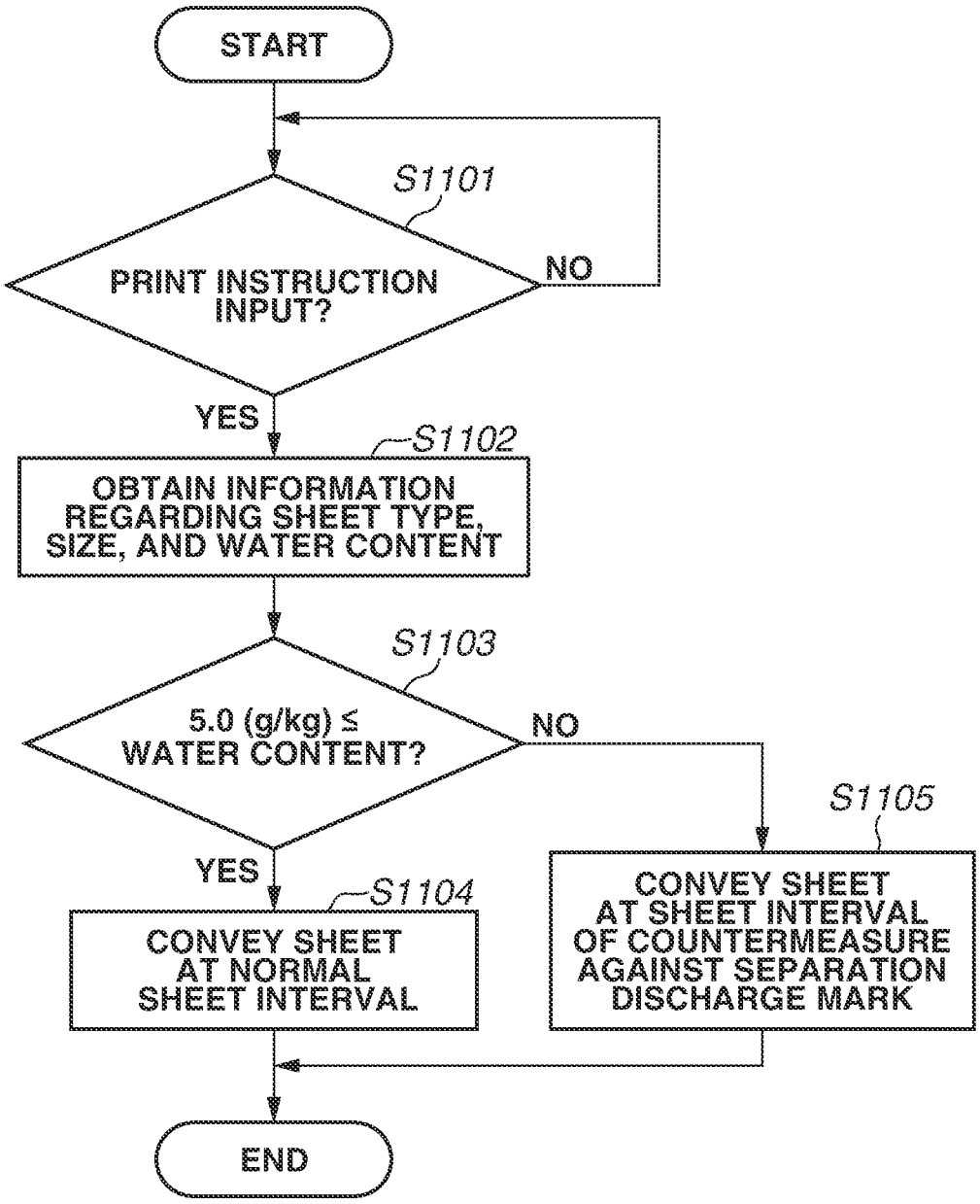
FIG. 16 is a flowchart regarding control corresponding to an environment.

Next, execution of the image formation processing corresponding to the environment is described with reference to a flowchart illustrated in FIG. 16 and a block diagram illustrated in FIG. 17. FIG. 16 is the flowchart regarding control corresponding to an environment.

The control illustrated in the flowchart is performed by the CPU 10 functioning as the execution unit (the controller) executing a control program stored in the built-in storage unit. The storage unit is not limited to the one built in the CPU 10, and a memory which is separated from and electrically connected to the CPU 10 is provided in the image forming apparatus 1 and may be configured to function as a storage unit for storing a program and data.

Figure 17:
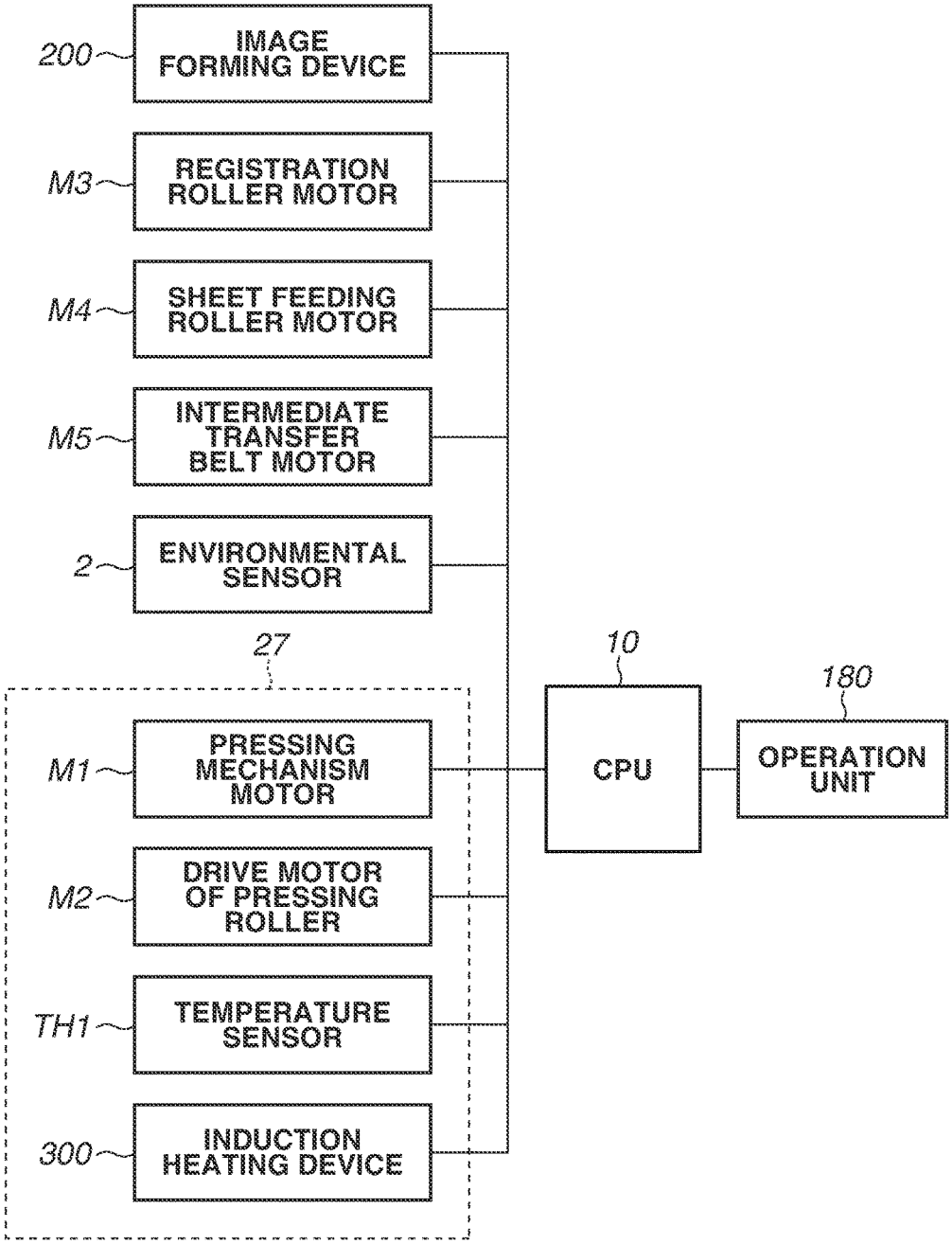
FIG. 17 is a block diagram illustrating an example of a configuration of the control system.

The CPU 10 is electrically connected to the image forming device 200 as illustrated in FIG. 17 and controls the image formation operation by the image forming device 200. Further, the CPU 10 is connected to the registration roller motor M3, the sheet feeding roller motor M4, the intermediate transfer belt motor M5, the environmental sensor 2, and the fixing device 27 and control the image formation operation, the fixing operation, and the conveyance of the sheet P.

When the image forming apparatus 1 receives an energization command (for example, turning on of the power source switch), the CPU 10 shifts to the start-up control and then enters the state waiting for input of a print command.

The print command is a command to the image forming device 200 to execute the image formation processing. The print command is, for example, an instruction to start printing input by the operator from the operation unit 180 or the external personal computer and an instruction to start copying input by the operator from the operation unit 180.

When the start-up control is completed, the image forming apparatus 1 enters the state ready for starting the image formation processing. The start-up control is a preparation operation for shifting the fixing device 27 to a state ready for starting the fixing processing in association with the energization command of the image forming apparatus 1. Specifically, in the start-up processing, energization to the induction heating device 300 is started, and a heating operation of the fixing belt 100 is performed. In the start-up control, a preparation operation for shifting the image forming device 200 to a state ready for starting the image formation processing is also performed in parallel. In the case that the preparation operation of the image forming device 200 is not completed even when the preparation operation of the fixing device 27 is completed, the start-up control of the image forming apparatus 1 may be completed in association with the completion of the preparation operation of the image forming device 200.

When the image forming apparatus 1 receives a restoration command (e.g., pressing of a restoration button) from a power saving mode, the CPU 10 also shifts to the start-up control and then enters the state waiting for input of the print command. The power saving mode is a state in which power supply to devices is stopped other than the CPU and the like in charge of control of various devices.

When the print command as a reservation job is input during the start-up control, the CPU 10 starts the image formation corresponding to the reservation job after completion of the start-up control without shifting to the state waiting for input of the print command.

In step S1101, when the print command is input to the CPU 10 in the state waiting for input of the print command (YES in step S1101), the CPU 10 advances the processing to step S1102.

In step S1102, the CPU 10 obtains the sheet information including the information pieces corresponding to the size, the basis weight, and the type of the sheet material of the sheet P on which the toner image is formed by the print command and the value of the water content in the air.

Specifically, the information pieces corresponding to the size, the basis weight, and the type of the sheet material of the sheet P on which the toner image is formed by the print command are input from the operation unit 180 or the external personal computer as an instruction by the operator. According to the present and below-described embodiments, a case is described as an example in which the image formation processing to be executed with respect to the input print command is to continuously perform the image formation on a plurality of the predetermined sheets P (i.e., the sheets P having the predetermined size and the predetermined type). The plurality of the sheets P described as the example here has the same size and the same type with each other (i.e., the sheets having the same size, the same basis weight, and the same material). An example is a case when printing is performed on ten sheets of the A4 size plain paper. In addition, the CPU 10 obtains the temperature and the relative humidity detected by the environmental sensor 2 in association with the input of the print command. The CPU 10 determines the value of the water content in the air based on the temperature and the relative humidity obtained in association with the input of the print command.

Next, in step S1103, the CPU 10 determines whether the determined value of the water content in the air is 5.0 (g/kg) or more. When the value of the water content in the air is 5.0 (g/kg) or more (i.e., the predetermined water content or more, YES in step S1103), then in step S1104, the CPU 10 conveys the sheet P to the fixing nip portion N so that the sheet interval time becomes the normal sheet interval time P1. The sheet interval time P1 is determined based on the sheet information obtained in step S1102. For example, a table in which the sheet information is associated with the sheet interval time P1 is stored in advance in the storage unit, and the CPU 10 determines the sheet interval time P1 by referring to the table based on the information obtained in step S1102. The sheet interval time is, as described above, a time length from when the trailing edge of the preceding sheet (the x-th sheet) passes through the fixing nip portion N to when the leading edge of the subsequent sheet (the (x+1)-th sheet) conveyed to the fixing nip portion N next to the preceding sheet passes through the fixing nip portion N.

On the other hand, when the value of the water content in the air is less than 5.0 (g/kg) (i.e., less than the predetermined water content, NO in step S1103), then in step S1105, the CPU 10 conveys the sheet P to the fixing nip portion N so that the sheet interval time becomes the above-described time P2 prioritizing the image quality. The sheet interval time P2 of the countermeasure against the separation discharge mark is, as described above, the sheet interval time set so that the portion brought into contact with the trailing edge portion of the preceding sheet on the circumference surface of the fixing belt 100 comes into the margin area on the leading edge side of the subsequent sheet. The sheet interval time P2 is determined based on the sheet information obtained in step S1102. For example, a table in which the sheet information is associated with the sheet interval time P2 is stored in advance in the storage unit, and the CPU 10 determines the sheet interval time P2 by referring to the table based on the information obtained in step S1102.

Here, an additional explanation is provided about obtainment of the water content in the air in step S1102.

When the print command is input to the image forming apparatus 1 which waits for the input of the print command in the state ready for starting the image formation processing, the CPU 10 obtains the value of the water content in the air using the input of the print command as a trigger. Specifically, the CPU 10 determines the water content in the air during a period from when the print command is input to when the image formation corresponding to the first sheet P for the print command is completed (more specifically, to when the exposure device 22 completes exposure of the image data corresponding to the first sheet P). For example, the determination may be immediately after the input of the print command or may be when execution of the image formation processing corresponding to the print command is started (more specifically, when the exposure device 22 starts exposure corresponding to the image data).

According to the present embodiment, the environmental sensor 2 constantly measures the temperature and the relative humidity inside the image forming apparatus 1, and the CPU 10 reads the detection result of the environmental sensor 2 in response to the input of the print command. The environmental sensor 2 may be configured to measure the temperature and the relative humidity inside the image forming apparatus 1 at a necessary timing when receiving an instruction from the CPU 10. Further, for the temperature and the humidity used for determining the water content in the air, the detection result detected by the environmental sensor 2 at a predetermined timing from when the print command is input to when the image formation corresponding to the first sheet P for the print command is completed may be used.

The conveyance of the sheet P is described in more detail. According to the present embodiment, the CPU 10 controls the motor M3 of the registration roller 33 to change a time for stopping the sheet P next to the preceding sheet at the registration roller 33 and thus adjusts the sheet interval time. When the image formation is performed in the same conditions, the rotation speed of the pressing roller 600 is the same in the normal mode other than that under the low humidity environment and when the countermeasure against the separation discharge mark is taken under the low humidity environment.

Specifically, the CPU 10 drives the sheet feeding roller motor M4 of the sheet feeding cassette (the cassette 31 here) storing the sheet P on which the toner image is formed with respect to the print command input in step S1101. Accordingly, the CPU 10 feeds the first sheet P for the print command input in step S1101 to the sheet feeding roller 32 from the cassette 31. The fed first sheet P is conveyed to the registration roller 33.

The CPU 10 also causes the image forming device 200, the intermediate transfer belt motor M5, and the fixing device 27 to start operations. The CPU 10 causes the image forming device 200 to form an image to be transferred to the first sheet P. The CPU 10 causes the registration roller 33 to feed out the sheet P to the transfer nip portion in accordance with a timing at which the toner image corresponding to the first sheet P on the intermediate transfer belt 25 reaches the transfer nip portion.

When the registration roller 33 completes feeding out of the first sheet P, the CPU 10 stops the second sheet P at the registration roller 33. The image forming device 200 forms an image to be transferred to the second sheet P with the predetermined sheet interval following the image to be transferred to the first sheet P. The CPU 10 causes the image forming device 200 to form the toner images on the intermediate transfer belt 25 so that an interval between the toner image to be transferred to the first sheet and the toner image to be transferred to the second sheet to be an interval corresponding to the sheet interval time corresponding to the environment.

The CPU 10 controls the registration roller motor M3 to feed out the sheet P in accordance with a timing at which the toner image on the intermediate transfer belt 25 corresponding to the second sheet P which is formed with an image interval based on the sheet interval time corresponding to the environment reaches the transfer nip portion. In other words, in the case of the sheet interval of the countermeasure against the separation discharge mark under the low humidity environment, the CPU 10 causes the registration roller 33 to stop the second sheet P until the sheet interval time P2 to the first sheet P has elapsed. The sheet interval time is, as described above, a time length from when the trailing edge of the preceding sheet passes through the fixing nip portion N to when the leading edge of the subsequent sheet conveyed to the fixing nip portion N next to the preceding sheet passes through the fixing nip portion N.

In other words, the sheet interval time between the preceding sheet and the subsequent sheet at the fixing nip portion N is adjusted by the time during which the sheet is stopped at the registration roller 33.

When the time to stop the sheet at the registration roller 33 has elapsed, the CPU 10 drives the registration roller motor M3 to rotate the registration roller 33 and starts the conveyance of the second sheet P. When being conveyed at the normal sheet interval, the second sheet P passed through the transfer nip portion passes through the fixing nip portion N at the sheet interval time P1 to the first sheet P, and when being conveyed at the sheet interval of the countermeasure against the separation discharge mark, the second sheet P passes through the fixing nip portion N at the sheet interval time P2 to the first sheet P.

Regarding the conveyance of the third sheet P, the CPU 10 similarly controls the conveyance of the third sheet P so that the sheet interval time to the second sheet P becomes the sheet interval time corresponding to the environment. The processing is similarly performed until the last sheet P corresponding to the input print command is conveyed.

As described above, the registration roller 33 feeds out the sheet P in accordance with a timing at which the toner image on the intermediate transfer belt 25 corresponding to the subsequent sheet P reaches the transfer nip portion and realizes the conveyance of the sheet P at the sheet interval determined based on the sheet information.

Here, a setting value of the sheet interval time when an A4 size sheet P passes through is described as an example in each mode. According to the present embodiment, the outer diameter of the fixing belt 100 is 30 mm, the circumferential length is approximately 94 mm, and the size of the margin portion is 3.5 mm. These values are examples, and the present embodiment is not limited to them. In addition, the length of the A4 size sheet P in the conveyance direction is approximately 210 mm.

A setting of the sheet interval time of the countermeasure against the separation discharge mark under the low humidity environment according to the present embodiment is described. In order to bring the portion brought into contact with the trailing edge of the preceding sheet on the fixing belt 100 into contact with the inside of the margin area on the leading edge side of the subsequent sheet, a target sheet interval is set here based on a position at which the portion brought into contact with the trailing edge of the preceding sheet is brought into contact with a center portion of the margin area on the leading edge side of the sheet P in the conveyance direction. In other words, the target sheet interval is the interval obtained by adding a value dividing the length of the margin portion by two to the length of one round of the fixing belt. When the diameter of the fixing belt 100 is 30 mm, the circumferential length is approximately 94 mm, and the size of the margin portion is 3.5 mm, the target sheet interval is approximately 92.5 mm. When the target sheet interval is divided by the rotation speed of the fixing belt 100 determined by the sheet type, the sheet interval time P2 can be calculated.

The storage unit in the image forming apparatus 1 stores in advance a value of the sheet interval time corresponding to the sheet interval of the countermeasure against the separation discharge mark calculated as described above. The CPU 10 controls the conveyance of the sheet P at the sheet interval time corresponding to the water content in the air determined based on the values of the temperature and the relative humidity detected by the environmental sensor 2. When the conveyance is performed at the sheet interval of the countermeasure against the separation discharge mark, the CPU 10 may calculate the sheet interval time of the sheet interval of the countermeasure against the separation discharge mark as described above according to the obtained the sheet information.

Accordingly, the sheet interval is adjusted so that the portion brought into contact with the trailing edge portion of the preceding sheet P comes into the margin area of the subsequent sheet under the low humidity environment. In other words, under the low humidity environment, the image forming apparatus 1 can bring the portion at which the separation discharge occurred into contact with the margin area on the leading edge side of the (x+1)-th sheet before bringing it into contact with the image area of the (x+1)-th sheet even when the separation discharge mark is generated on the fixing belt 100 by the trailing edge portion of the x-th sheet P. Accordingly, the separation discharge mark on the fixing belt 100 can be relieved, and the image streak can be restrained from becoming apparent in the image area of the (x+1)-th sheet.

According to the present embodiment, the case in which the A4 size sheet P is used is described as a specific example for continuously performing the image formation on a plurality of the sheets P, however, the size of the sheet P is not limited to the A4 size. Even when the sheet P having the maximum width size (the size in the direction perpendicular to the conveyance direction) which can be conveyed by the image forming apparatus 1 is used as a predetermined size and a predetermined type of the sheet P in the continuous image formation for a plurality of the sheets, the image forming apparatus 1 according to the present embodiment conveys the sheet P at the sheet interval time corresponding to the environment. In other words, under the low humidity environment, the CPU 10 controls the conveyance of the sheet P so that the sheet interval time is the one in which the portion brought into contact with the trailing edge portion of the preceding sheet (the x-th sheet) on the circumference surface of the fixing belt 100 is brought into contact with the inside of the margin area on the leading edge side of the subsequent sheet (the (x+1)-th sheet). However, the specific values of the sheet interval times P1 and P2 may be different from those of when the A4 size sheet P is used.

Further, the image forming apparatus 1 is configured to convey the sheet P at the sheet interval time corresponding to the environment even when the image formation is performed on a plurality of sheets in which different size, such as A3, B5, and A3 size sheets P are mixed. In other words, under the low humidity environment, the CPU 10 controls the conveyance of the sheet P so that the sheet interval time is the one in which the portion brought into contact with the trailing edge portion of the preceding sheet (the x-th sheet) on the circumference surface of the fixing belt 100 is brought into contact with the inside of the margin area on the leading edge side of the subsequent sheet (the (x+1)-th sheet). In this case, the specific values of the sheet interval times P1 and P2 may be different in each size of the sheet P.

According to the present embodiment, the sheet interval time under the low humidity environment is adjusted by the CPU 10 controlling the timing of driving and stopping the registration roller 33, however, the method for adjusting the sheet interval time is not limited thereto. For example, the CPU 10 may control a timing of feeding out the sheet P by the sheet feeding roller 32 in accordance with the sheet interval time.

According to the present embodiment, the sheets P are conveyed at the constant sheet interval time (the time P1 in the normal sheet interval, and the time P2 in the sheet interval of the countermeasure against the separation discharge mark) from the first sheet to the last sheet P corresponding to the input print command in the image formation corresponding to the input print command. However, when the image formation processing is interrupted due to, for example, occurrence of a jam and occurrence of an abnormal temperature rise in a member, the sheet interval time before and after the interruption may not be the sheet interval time corresponding to the environment as an exception. For example, when a jam occurs during the conveyance at the sheet interval of the countermeasure against the separation discharge mark, the sheet interval time between the x-th sheet P immediately before the occurrence of the jam and the (x+1)-th sheet P immediately after the occurrence of the jam does not have to satisfy the sheet interval time for the sheet interval of the countermeasure against the separation discharge mark. Even in this case, it is regarded as the configuration within the scope of the present embodiment.

A case when the image formation processing is interrupted is not limited to occurrence of abnormality such as occurrence of a jam and occurrence of an abnormal temperature rise in a member. For example, a case is included in which the image formation processing is temporarily interrupted by processing which is regularly executed by interrupting the sheet interval such as calibration processing of the image forming device. In this case also, the sheet interval time before and after the interruption by the interrupting processing does not have to be the sheet interval time corresponding to the environment as an exception.

As described above, when the water content in the air is less than 5.0 (g/kg), the image forming apparatus 1 executes the conveyance of the sheet P at the sheet interval of the countermeasure against the separation discharge mark. In other words, in the case of the low humidity environment, the image forming apparatus 1 conveys the sheet P to the fixing nip portion N so that the sheet interval time P2 is attained in which the portion brought into contact with the trailing edge portion of the preceding sheet (the x-th sheet) on the circumference surface of the fixing belt 100 is brought into contact with the inside of the margin area on the leading edge side of the subsequent sheet (the (x+1)-th sheet).

Accordingly, the image forming apparatus 1 can restrain the image streak from becoming apparent in the low humidity environment.

Further, when the water content in the air is 5.0 (g/kg) or more, the image forming apparatus 1 conveys the sheet P at the normal sheet interval prioritizing the productivity. Accordingly, the image forming apparatus 1 can restrain the image streak due to the separation discharge on the fixing device from becoming apparent under the low humidity environment and also can restrain the productivity from being reduced under the environment other than the low humidity environment.

According to the configuration of the second embodiment, the CPU 10 automatically controls the sheet interval of the sheet P according to the environment (specifically, the water content in the air). On the other hand, according to a third embodiment, a configuration is described which can execute a mode for conveying the sheet P at the normal sheet interval regardless of the water content in the air in addition to the mode for automatically performing control according to the environment as described in the second embodiment. The members having the configurations similar to those in the second embodiment are denoted by the same reference numerals, and thus the detail descriptions thereof are omitted.

<Setting of Countermeasure Mode>

The image forming apparatus 1 according to the present embodiment (FIG. 14) allows an operator to set a mode on the display unit 180B in the operation unit 180 from among a plurality of modes including the normal mode placing emphasis on the productivity and a low humidity environment countermeasure mode placing emphasis on the image quality corresponding to the needs of the user.

The image streak due to the separation discharge becomes more remarkably apparent in a halftone image but does not become apparent in all of users' resultant products. For example, for a user who mainly prints an image of a document, the image streak due to the separation discharge often cannot be visually recognized or is in a degree not annoying even it is visually recognized. For such a user, it is required not to reduce the productivity than to take a countermeasure against the image streak by reducing the productivity. Therefore, the image forming apparatus 1 executes the normal mode placing emphasis on the productivity to cope with the needs of the user who places emphasis on the productivity than the image quality.

The normal mode is the mode for prioritizing the productivity. In the normal mode, the sheet interval time is P1 (ms) regardless of the water content in the air, and the portion abutted on the trailing edge of the preceding sheet (the x-th sheet) on the circumference surface of the fixing belt 100 comes into the image area of the subsequent sheet (the (x+1)-th sheet). In other words, the normal mode is a mode for conveying the sheet P at the normal sheet interval according to the second embodiment regardless of the water content in the air. Further, the normal mode according to the present embodiment is similar to the normal mode according to the first embodiment.

On the other hand, the low humidity environment countermeasure mode is a mode for performing the control described in the second embodiment. In other words, the low humidity environment countermeasure mode is a mode for conveying the sheet P at the normal sheet interval (the sheet interval time: P1) in the case other than the low humidity environment and conveying the sheet P at the sheet interval of the countermeasure against the separation discharge mark (the sheet interval time: P2) in the low humidity environment as described in the second embodiment. The sheet interval of the countermeasure against the separation discharge mark is, as described above, the sheet interval in which the portion brought into contact with the trailing edge portion of the preceding sheet on the circumference surface of the fixing belt 100 comes into the margin area of the subsequent sheet. According to the present embodiment, the low humidity environment also refers to an environment of which the water content in the air is less than 5.0 (g/kg).

Figure 18:
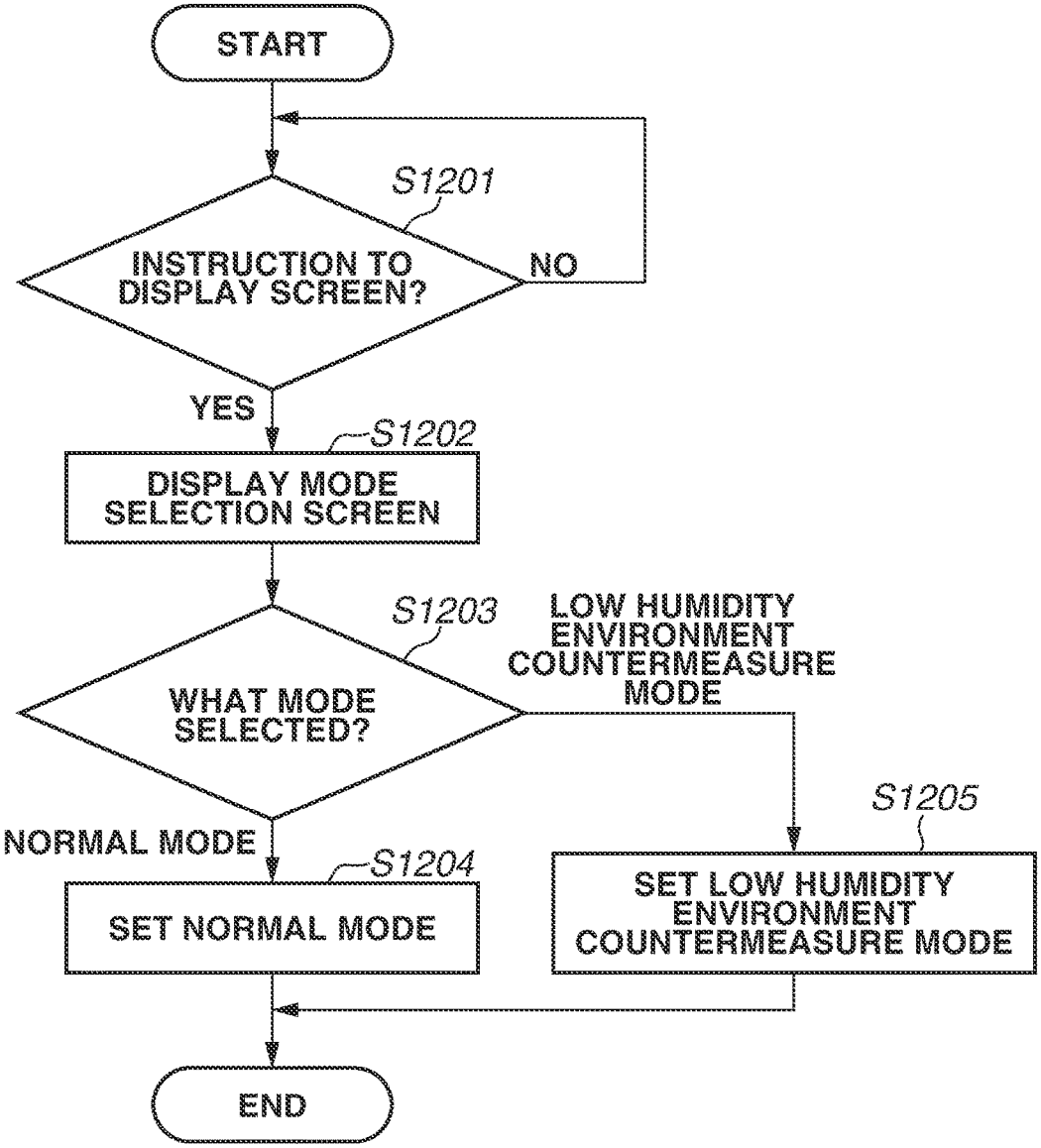
FIG. 18 is a flowchart regarding the mode setting.

A control flow for setting the mode is described with reference to a flowchart illustrated in FIG. 18 and the block diagram illustrated in FIG. 17. The control illustrated in the flowchart is performed by the CPU 10 functioning as the execution unit (the controller) executing a control program stored in the built-in storage unit. FIG. 18 is the flowchart regarding the mode setting. The CPU 10 is electrically connected to the operation unit 180.

Figure 19:
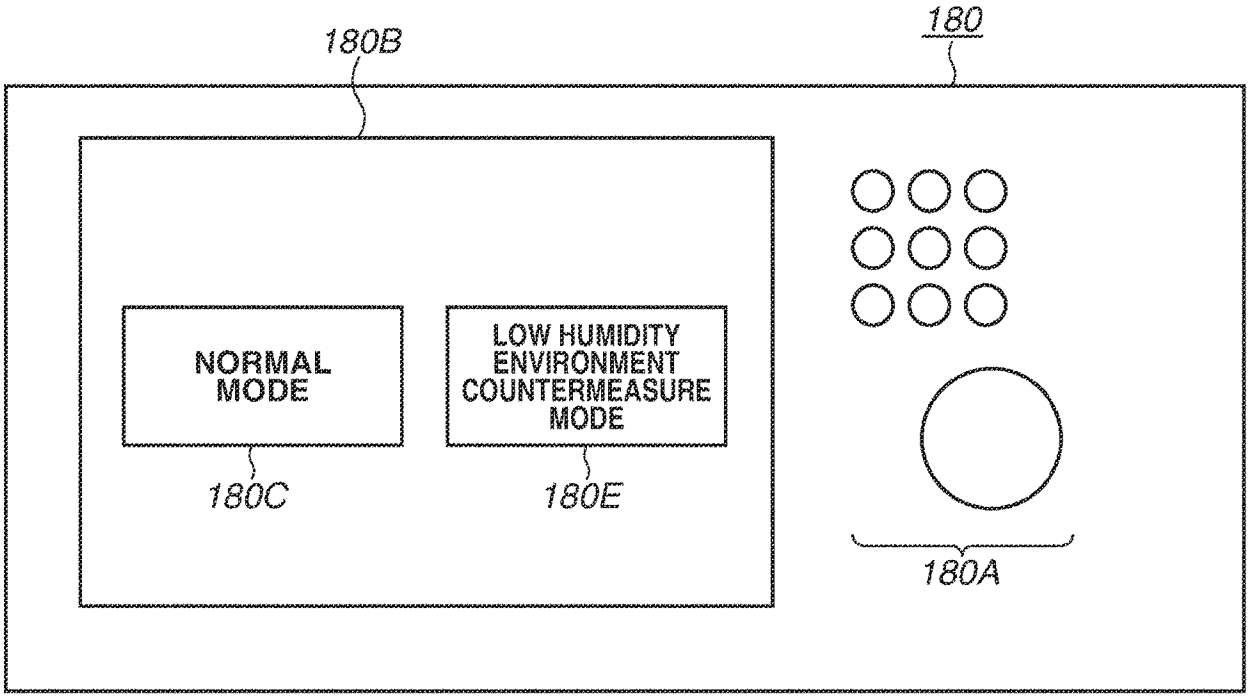
FIG. 19 illustrates an example of the mode selection screen.

In step S1201, when the operator inputs an instruction to display the mode selection screen to the operation unit 180 (YES in step S1201), then in step S1202, the CPU 10 displays the mode selection screen on the display unit 180B in the operation unit 180. Specifically, the CPU 10 displays the soft key 180C of the "normal mode" and a soft key 180E of the "low humidity environment countermeasure mode" on the display unit 180B as illustrated in FIG. 19. FIG. 19 illustrates an example of the mode selection screen.

In step S1203, when the soft key 180C of the "normal mode" is pressed on the mode selection screen (i.e., the selected mode is the "normal mode"), then in step S1204, the CPU 10 sets the normal mode placing emphasis on the productivity. When the soft key 180E of the "low humidity environment countermeasure mode" is pressed on the mode selection screen (i.e., the selected mode is the "low humidity environment countermeasure mode"), then in step S1205, the CPU 10 sets the low humidity environment countermeasure mode placing emphasis on the image quality. Subsequently, the image formation processing is executed according to the mode. The CPU 10 stores the information corresponding to the set mode in the storage unit built in the CPU 10.

Accordingly, the user can select the mode to be executed by the image forming apparatus 1 according to the needs of himself/herself.

According to the present embodiment, the operator inputs an instruction to display the mode selection screen using the operation unit 180, and thus the mode can be selected or changed in the image forming apparatus 1. Once the mode is set, the mode executed by the CPU 10 is not changed unless the operator changes the selected mode on the mode selection screen. Accordingly, once the mode is set, the operator does not need to repeat the mode setting unless necessary.

In this regard, the normal mode may be set as the initial setting. In this case, when the operator does not input an instruction to display the mode selection screen, the CPU 10 executes the normal mode. Further, the operator can change the setting from the initial setting on the mode selection screen.

According to the present embodiment, the example is described in which the options of the modes include two of the normal mode placing emphasis on the productivity and the countermeasure mode placing emphasis on the image quality, however, other modes may be provided as modes which can be set in the image forming apparatus 1. Further, according to the present embodiment, the mode is selected by pressing the soft key, however, the mode may be selected using the operation button unit 180A.

<Execution of Image Formation Processing Corresponding to Mode>

Figure 20:
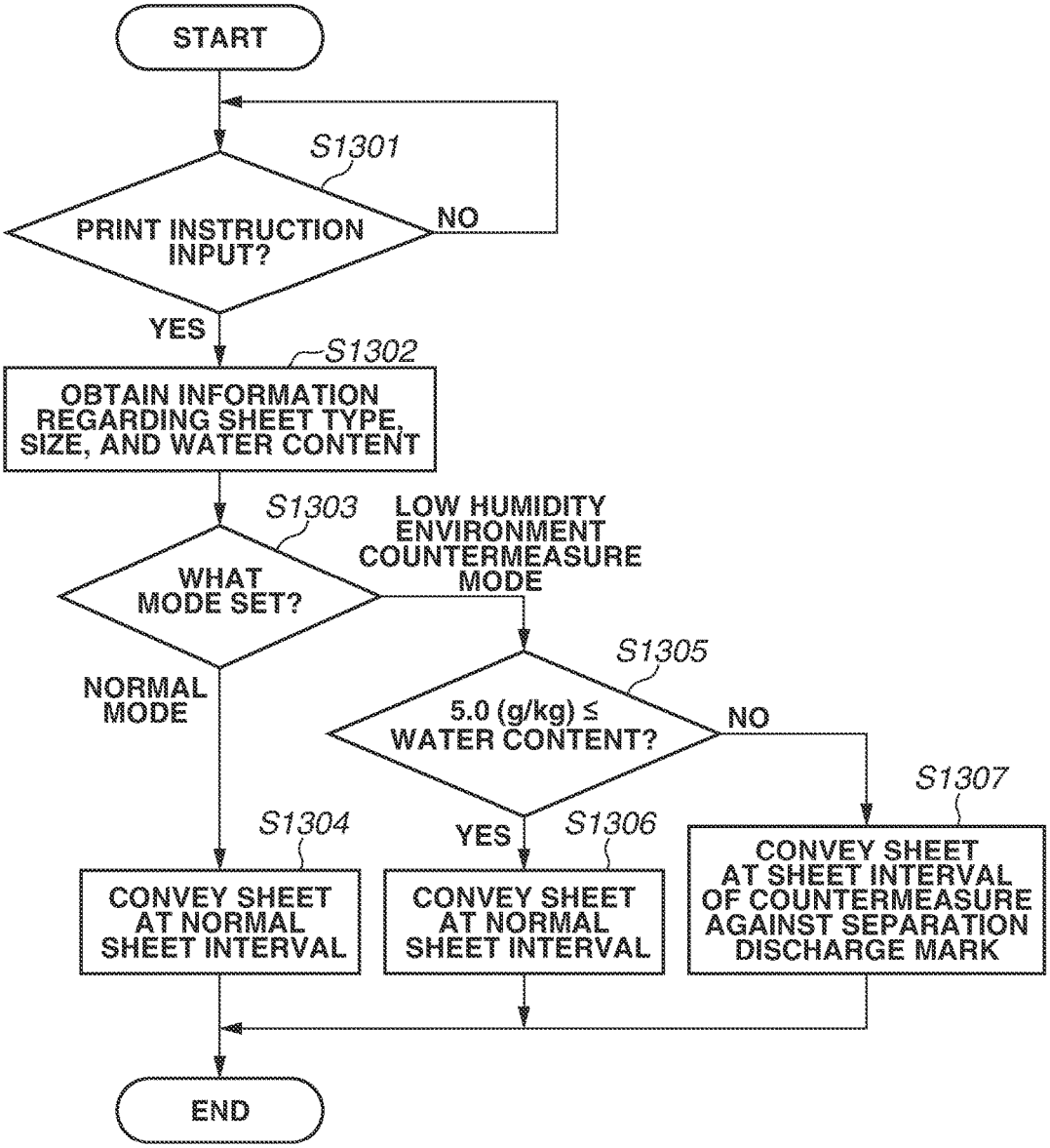
FIG. 20 is a flowchart regarding control corresponding to a mode.

Next, execution of the image formation processing corresponding to the mode is described with reference to a flowchart illustrated in FIG. 20. FIG. 20 is the flowchart regarding the control corresponding to the mode. The control illustrated in the flowchart is performed by the CPU 10 functioning as the execution unit (the controller) executing a control program stored in the built-in storage unit.

When the image forming apparatus 1 receives an energization command (for example, turning on of the power source switch), the CPU 10 shifts to the start-up control and then enters the state waiting for input of a print command. As described above, when the start-up control is completed, the image forming apparatus 1 enters the state ready for starting the image formation processing.

In step S1301, when the print command is input to the CPU 10 in the state waiting for input of the print command (YES in step S1301), the CPU 10 advances the processing to step S1302. In step S1302, the CPU 10 obtains the sheet information including the information pieces corresponding to the size, the basis weight, and the type of the sheet material of the sheet P on which the toner image is formed by the print command and the value of the water content in the air. The details of the processing in steps S1301 and S1302 are respectively similar to those in steps S1101 and S1102 in FIG. 16, and thus the descriptions thereof are omitted.

Next, in step S1303, the CPU 10 refers to the storage unit and determines the mode set to the image forming apparatus 1. The mode setting is as described above.

The CPU 10 executes the set mode. In other words, the CPU 10 selectively executes the set mode from among the plurality of modes including the normal mode placing emphasis on the productivity and the low humidity environment countermeasure mode placing emphasis on the image quality.

In step S1303, when the set mode is the "normal mode", then in step S1304, the CPU 10 conveys the sheet P to the fixing nip portion N so that the sheet interval time becomes the time P1 prioritizing the productivity (the normal sheet interval). The sheet interval time P1 is determined based on the sheet information obtained in step S1302. For example, the table in which the sheet information is associated with the sheet interval time P1 is stored in advance in the storage unit, and the CPU 10 determines the sheet interval time P1 by referring to the table based on the information obtained in step S1302. The sheet interval time is, as described above, a time length from when the trailing edge of the preceding sheet (the x-th sheet) passes through the fixing nip portion N to when the leading edge of the subsequent sheet (the (x+1)-th sheet) conveyed to the fixing nip portion N next to the preceding sheet passes through the fixing nip portion N.

On the other hand, in step S1303, when the set mode is the "low humidity environment countermeasure mode", then in step S1305, the CPU 10 determines whether the determined water content in the air is 5.0 (g/kg) or more. The details of the determination of the water content in the air are described above in association with the processing in step S1102 in FIG. 16, and thus the descriptions thereof are omitted.

When the water content in the air is 5.0 (g/kg) or more (YES in step S1305), then in step S1306, the CPU 10 conveys the sheet P to the fixing nip portion N so that the sheet interval time becomes the normal sheet interval time P1. On the other hand, when the water content in the air is less than 5.0 (g/kg) (NO in step S1305), then in step S1307, the CPU 10 conveys the sheet P to the fixing nip portion N so that the sheet interval time becomes the above-described time P2 prioritizing the image quality (at the sheet interval of the countermeasure against the separation discharge mark). The details of the processing in steps S1306 and S1307 are respectively similar to those in steps S1104 and S1105 in FIG. 16, and thus the descriptions thereof are omitted.

The details of the conveyance of the sheet P are similar to those in the second embodiment, and thus the descriptions thereof are omitted.

When the set mode is the "normal mode", the CPU 10 does not have to determine the water content in the air. In other words, the CPU 10 may be configured to obtain the detection result of the environmental sensor 2 and determine the water content in the air only when it is determined that the set mode is the "low humidity environment countermeasure mode" in step S1303 prior to the determination of the water content (in step S1305).

As described above, the image forming apparatus 1 allows the operator to set a mode on the display unit 180B in the operation unit 180 from among the plurality of modes including the normal mode placing emphasis on the productivity and the low humidity environment countermeasure mode placing emphasis on the image quality in response to the needs of the user. Accordingly, the user can select the mode to be executed by the image forming apparatus 1 according to the needs of himself/herself.

As described above, the image forming apparatus 1 executes the normal mode when the normal mode is set and conveys the sheet P to the fixing nip portion N so that the sheet interval time P1 prioritizing the productivity is attained regardless of the value of the water content in the air. Accordingly, the image forming apparatus 1 can cope with the needs of the user who places emphasis on the productivity than the image quality in the low humidity environment.

Further, as described above, the image forming apparatus 1 executes the low humidity environment countermeasure mode when the low humidity environment countermeasure mode is set. The image forming apparatus 1 conveys the sheet P to the fixing nip portion N at the sheet interval of the countermeasure against the separation discharge mark (the sheet interval time: P2) when the water content in the air is less than 5.0 (g/kg) in the low humidity environment countermeasure mode. In the sheet interval of the countermeasure against the separation discharge mark, the portion brought into contact with the trailing edge portion of the preceding sheet (the x-th sheet) on the circumference surface of the fixing belt 100 is brought into contact with the inside of the margin area on the leading edge side of the subsequent sheet (the (x+1)-th sheet). Accordingly, the image forming apparatus 1 can restrain the image streak from becoming apparent in the low humidity environment and cope with the needs of the user who places emphasis on the image quality than the productivity.

Therefore, the image forming apparatus can be provided which can cope with the needs of the both of the user who places emphasis on the productivity and the user who places emphasis on the image quality.

According to a fourth embodiment, a configuration is described which can execute a mode for conveying the sheet P at the sheet interval of the countermeasure against the separation discharge mark regardless of the water content in the air in addition to the configuration of the third embodiment. The members having the configurations similar to those in the above-described second and third embodiments are denoted by the same reference numerals, and thus the detail descriptions thereof are omitted.

<Setting of Countermeasure Mode>

The image forming apparatus 1 (FIG. 14) allows the operator to set one mode from among the plurality of modes including the normal mode, the low humidity environment countermeasure mode, and an all environment countermeasure mode on the display unit 180B in the operation unit 180 in response to the needs of the user.

The normal mode and the low humidity environment countermeasure mode are as described above in the third embodiment.

The all environment countermeasure mode is a mode for prioritizing the image quality, and the sheet interval time is P2 (ms) regardless of the water content in the air. In the all environment countermeasure mode, the portion brought into contact with the trailing edge portion of the preceding sheet (the x-th sheet) on the circumference surface of the fixing belt 100 is brought into contact with the margin area on the leading edge side of the subsequent sheet (the (x+1)-th sheet). The sheet interval time P2 is set to a time length calculated from the circumferential length of the fixing belt 100 so that the portion brought into contact with the trailing edge portion of the preceding sheet on the circumference surface of the fixing belt 100 comes into the margin area of the subsequent sheet. In other words, the all environment countermeasure mode is a mode for conveying the sheet P at the sheet interval of the countermeasure against the separation discharge mark according to the second embodiment regardless of the water content in the air.

The all environment countermeasure mode is executed, and thus the image forming apparatus 1 can cope with the needs of the user who wants to more certainly restrain the image streak due to the separation discharge on the fixing device from becoming apparent. For example, the image forming apparatus 1 can cope with a case in which a user uses a sheet (high-resistance sheet) which easily causes the separation discharge in the image forming apparatus 1 and also places emphasis on the image quality.

Figure 21:
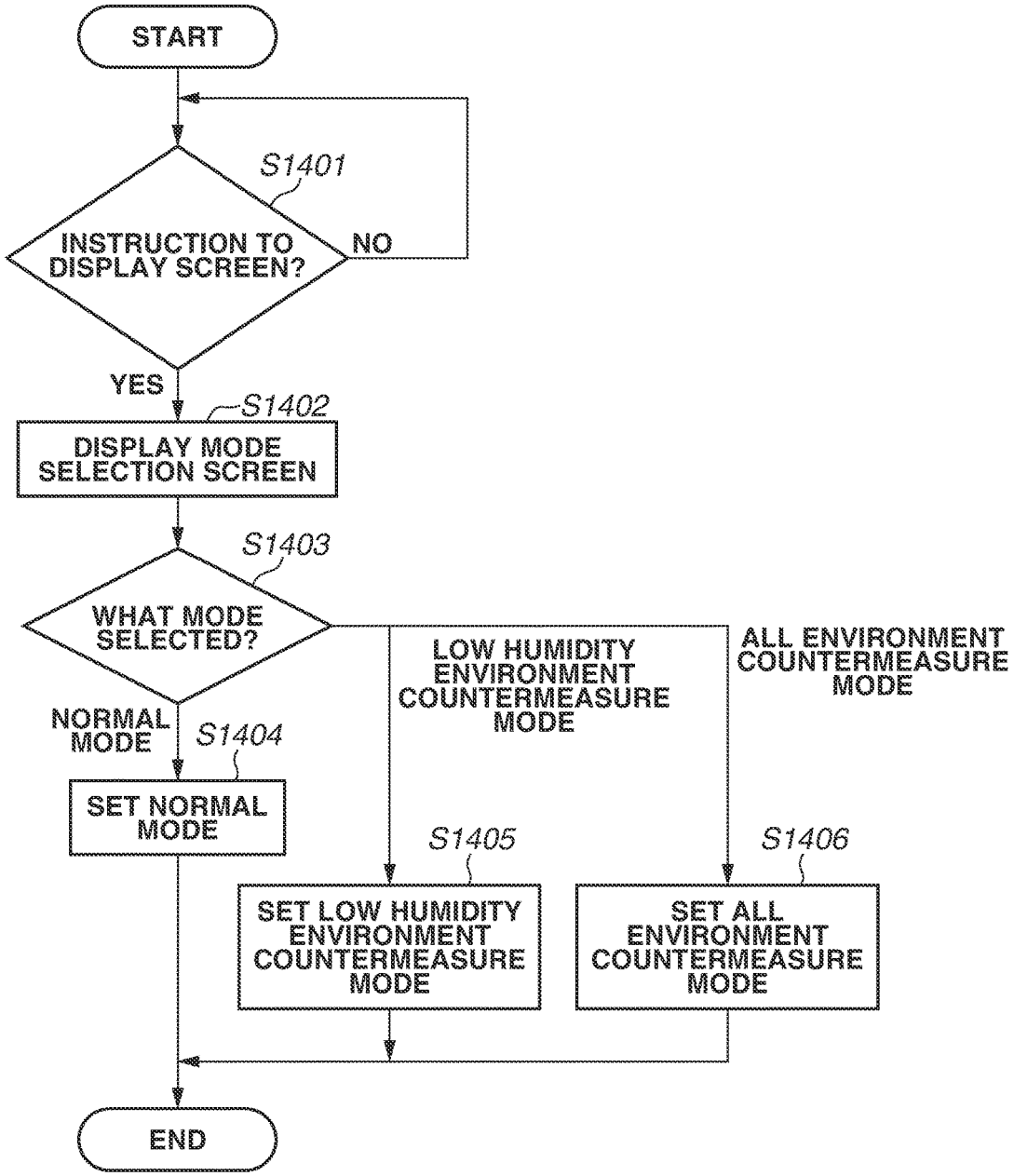
FIG. 21 is a flowchart regarding the mode setting.

A control flow for setting the mode is described with reference to a flowchart illustrated in FIG. 21 and the block diagram illustrated in FIG. 17. The control illustrated in the flowchart is performed by the CPU 10 functioning as the execution unit (the controller) executing a control program stored in the built-in storage unit. FIG. 21 is the flowchart regarding the mode setting. The CPU 10 is electrically connected to the operation unit 180.

Figure 22:
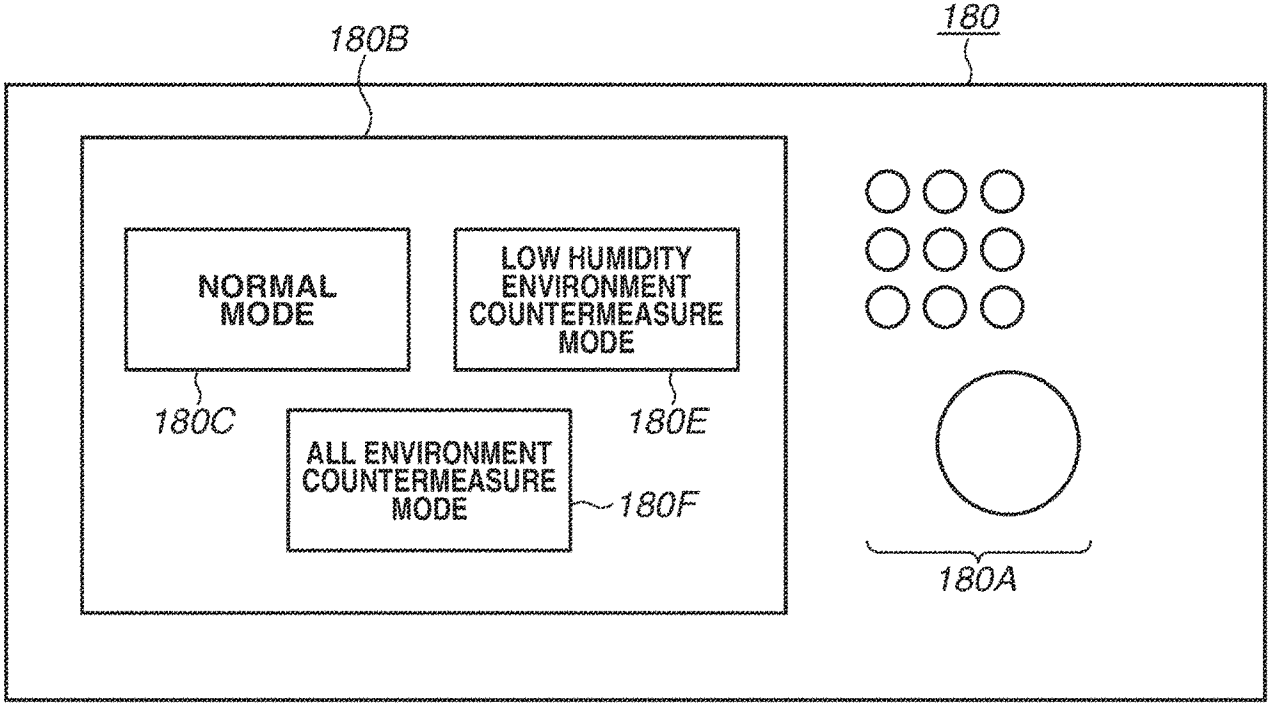
FIG. 22 illustrates an example of the mode selection screen.

In step S1401, when the operator inputs an instruction to display the mode selection screen to the operation unit 180 (YES in step S1401), then in step S1402, the CPU 10 displays the mode selection screen on the display unit 180B in the operation unit 180. Specifically, the CPU 10 displays the soft key 180C of the "normal mode", the soft key 180E of the "low humidity environment countermeasure mode", and a soft key 180F of the "all environment countermeasure mode" on the display unit 180B as illustrated in FIG. 22. FIG. 22 illustrates an example of the mode selection screen.

In step S1403, when the soft key 180C of the "normal mode" is pressed on the mode selection screen (i.e., the selected mode is the "normal mode"), then in step S1404, the CPU 10 sets the normal mode. When the soft key 180E of the "low humidity environment countermeasure mode" is pressed on the mode selection screen (i.e., the selected mode is the "low humidity environment countermeasure mode"), then in step S1405, the CPU 10 sets the low humidity environment countermeasure mode. When the soft key 180F of the "all environment countermeasure mode" is pressed on the mode selection screen (i.e., the selected mode is the "all environment countermeasure mode"), then in step S1406, the CPU 10 sets the all environment countermeasure mode. Subsequently, the image formation processing is executed according to the mode. The CPU 10 stores the information corresponding to the set mode in the storage unit built in the CPU 10.

<Execution of Image Formation Processing Corresponding to Mode>

Figure 23:
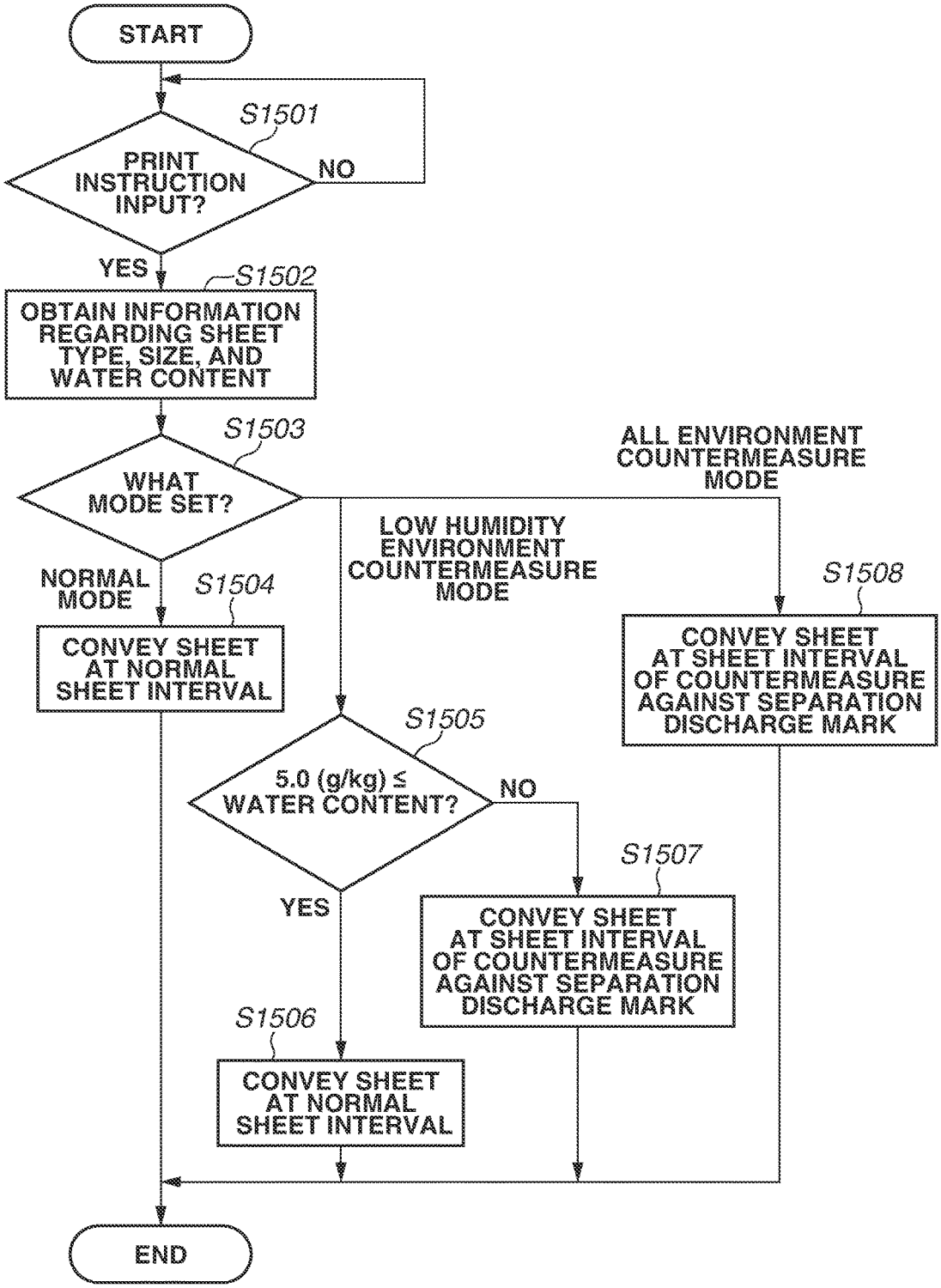
FIG. 23 is a flowchart regarding control corresponding to a mode.

Next, execution of the image formation processing corresponding to the mode is described with reference to a flowchart illustrated in FIG. 23 and the block diagram illustrated in FIG. 17. FIG. 23 is the flowchart regarding the control corresponding the mode.

When the image forming apparatus 1 receives an energization command (for example, turning on of the power source switch), the CPU 10 shifts to the start-up control and then enters the state waiting for input of a print command. As described above, when the start-up control is completed, the image forming apparatus 1 enters the state ready for starting the image formation processing.

In step S1501, when the print command is input to the CPU 10 in the state waiting for input of the print command (YES in step S1501), the CPU 10 advances the processing to step S1502. In step S1502, the CPU 10 obtains the sheet information including the information pieces corresponding to the size, the basis weight, and the type of the sheet material of the sheet P on which the toner image is formed by the print command and the value of the water content in the air. The details of the processing in steps S1501 and S1502 are respectively similar to those in steps S1101 and S1102 in FIG. 16, and thus the descriptions thereof are omitted.

Next, in step S1503, the CPU 10 refers to the storage unit and determines the mode set to the image forming apparatus 1. The mode setting is as described above.

The CPU 10 executes the set mode. In other words, the CPU 10 selectively executes the set mode from among the plurality of modes including the normal mode, the low humidity environment countermeasure mode, and the all environment countermeasure mode.

In step S1503, when the set mode is the "normal mode", then in step S1504, the CPU 10 conveys the sheet P to the fixing nip portion N so that the sheet interval time becomes the time P1 prioritizing the productivity (the normal sheet interval). The sheet interval time P1 is determined based on the sheet information obtained in step S1502. The details of the processing are similar to that in step S1304 in FIG. 16, and thus the descriptions thereof are omitted.

On the other hand, when the set mode is the "low humidity environment countermeasure mode", then in step S1505, the CPU 10 determines whether the determined water content in the air is 5.0 (g/kg) or more. The details of the determination of the water content in the air are described above in association with the processing in step S1102 in FIG. 16, and thus the descriptions thereof are omitted.

When the water content in the air is 5.0 (g/kg) or more (YES in step S1505), then in step S1506, the CPU 10 conveys the sheet P to the fixing nip portion N so that the sheet interval time becomes the normal sheet interval time P1. On the other hand, when the water content in the air is less than 5.0 (g/kg) (NO in step S1505), then in step S1507, the CPU 10 conveys the sheet P to the fixing nip portion N so that the sheet interval time becomes the above-described time P2 prioritizing the image quality (the sheet interval of the countermeasure against the separation discharge mark).

The details of the processing in steps S1506 and S1507 are respectively similar to those in steps S1104 and S1105 in FIG. 16, and thus the descriptions thereof are omitted.

On the other hand, when the set mode is the "all environment countermeasure mode", then in step S1508, the CPU 10 conveys the sheet P to the fixing nip portion N so that the sheet interval time becomes the above-described time P2 prioritizing the image quality (the sheet interval of the countermeasure against the separation discharge mark). The sheet interval time P2 is, as described above, the sheet interval time set so that the portion brought into contact with the trailing edge portion of the preceding sheet on the circumference surface of the fixing belt 100 comes into the margin area on the leading edge side of the subsequent sheet as described above. The sheet interval time P2 is determined based on the sheet information obtained in step S1502. For example, the table in which the sheet information is associated with the sheet interval time P2 is stored in advance in the storage unit, and the CPU 10 determines the sheet interval time P2 by referring to the table based on the information obtained in step S1502.

The details of the conveyance of the sheet P are similar to those in the second embodiment, and thus the descriptions thereof are omitted.

In the all environment countermeasure mode, the sheets P are conveyed at the constant sheet interval time P2 (the sheet interval of the countermeasure against the separation discharge mark) from the first sheet to the last sheet P corresponding to the input print command in the image formation corresponding to the input print command. However, when the image formation processing is interrupted due to, for example, occurrence of a jam and occurrence of an abnormal temperature rise in a member, the sheet interval time before and after the interruption may not be the sheet interval time corresponding to the mode as an exception. For example, when a jam occurs during the conveyance at the sheet interval of the countermeasure against the separation discharge mark, there is a case that the sheet interval time between the x-th sheet P immediately before the occurrence of the jam and the (x+1)-th sheet P immediately after the occurrence of the jam may not satisfy the sheet interval time for the sheet interval of the countermeasure against the separation discharge mark. Even in this case, it is regarded as the configuration within the scope of the present embodiment.

A case when the image formation processing is interrupted is not limited to occurrence of abnormality such as occurrence of a jam and occurrence of an abnormal temperature rise in a member. For example, a case is included in which the image formation processing is temporarily interrupted by processing which is regularly executed by interrupting the sheet interval such as calibration processing of the image forming device. In this case also, the sheet interval time before and after the interruption by the interrupting processing does not have to be the sheet interval time corresponding to the set mode as an exception.

When the set mode is the "normal mode" or the "all environment countermeasure mode", the CPU 10 does not have to determine the water content in the air. In other words, the CPU 10 may be configured to obtain the detection result of the environmental sensor 2 and determine the water content in the air only when it is determined that the set mode is the "low humidity environment countermeasure mode" in step S1503 prior to the determination of the water content (in step S1505).

As described above, the image forming apparatus 1 allows the operator to set one mode from among the plurality of modes including the normal mode, the low humidity environment countermeasure mode, and the all environment countermeasure mode on the display unit 180B in the operation unit 180 in response to the needs of the user. Accordingly, the user can select the mode to be executed by the image forming apparatus 1 according to the needs of himself/herself.

As described above, the image forming apparatus 1 executes the normal mode when the normal mode is set and conveys the sheet P to the fixing nip portion N so that the sheet interval time P1 prioritizing the productivity is attained regardless of the value of the water content in the air. Accordingly, the image forming apparatus 1 can cope with the needs of the user who places emphasis on the productivity than the image quality in the low humidity environment.

Further, as described above, the image forming apparatus 1 executes the low humidity environment countermeasure mode when the low humidity environment countermeasure mode is set. The image forming apparatus 1 conveys the sheet P to the fixing nip portion N at the sheet interval of the countermeasure against the separation discharge mark (the sheet interval time: P2) when the water content in the air is less than 5.0 (g/kg) in the low humidity environment countermeasure mode. In the sheet interval of the countermeasure against the separation discharge mark, the portion brought into contact with the trailing edge portion of the preceding sheet (the x-th sheet) on the circumference surface of the fixing belt 100 is brought into contact with the inside of the margin area on the leading edge side of the subsequent sheet (the (x+1)-th sheet). Accordingly, the image forming apparatus 1 can restrain the image streak from becoming apparent in the low humidity environment and cope with the needs of the user who places emphasis on the image quality than the productivity.

Further, as described above, the image forming apparatus 1 conveys the sheet P to the fixing nip portion N so that the sheet interval of the countermeasure against the separation discharge mark (the sheet interval time: P2) is attained regardless of the value of the water content in the air when the all environment countermeasure mode is set. Accordingly, the image forming apparatus 1 can cope with the needs of the user who places emphasis on the image quality and wants to more certainly restrain the image streak due to the separation discharge on the fixing device from becoming apparent.

Therefore, the image forming apparatus can be provided which can cope with the needs of various users, such as a user who places emphasis on the productivity, a user who places emphasis on the image quality under the low humidity environment, and a user who places emphasis on the image quality more certainly.

According to the above-described second to fourth embodiments, the environmental sensor 2 constantly measures the temperature and the relative humidity inside the image forming apparatus 1 (FIG. 14), and the CPU 10 reads the detection result of the environmental sensor 2 in response to the input of the print command. Further, according to the above-described second to fourth embodiments, the environmental sensor 2 may be configured to measure the temperature and the relative humidity inside the image forming apparatus 1 at a necessary timing when receiving an instruction from the CPU 10.

However, the environmental sensor 2 may be configured to detect the temperature and the relative humidity on a regular basis (for example, every ten minutes) regardless of input of the print command. A case is described below as an example in which this configuration of the environmental sensor 2 is applied to the processing in FIG. 16 according to the second embodiment. The configuration of the environmental sensor 2 may be applied to the third and fourth embodiments.

Specifically, the environmental sensor 2 detects the temperature and the relative humidity inside the image forming apparatus 1 at every predetermined time (every ten minutes according to a fifth present embodiment) after an energization command is input to the image forming apparatus 1. In response to an input of the print command in a standby state for waiting the input of the print command (YES in step S1101), in step S1102, the CPU 10 determines the water content in the air based on the most recent detection result of the environmental sensor 2.

Further, the CPU 10 may be configured to determine the water content in the air at every predetermined time, and in response to the input of the print command in the standby state for waiting the input of the print command (YES in step S1101), in step S1103, the CPU 10 may determine the water content based on the most recent water content in the air.

For example, when execution of the image formation processing corresponding to the print command is started during a period from when the environmental sensor 2 detects the temperature and the relative humidity for the first time to a next detection (a period until ten minutes elapse according to the present embodiment), the water content in the air is determined based on the first detection result. The start of the execution of the image formation processing is, more specifically, that the exposure device 22 starts exposure corresponding to the image data. Further, for example, when the print command is input during the period from when the environmental sensor 2 detects the temperature and the relative humidity for the first time to the next detection (the period until ten minutes elapse according to the present embodiment), the water content in the air may be determined based on the first detection result.

The temperature and/or the humidity detected by the environmental sensor 2 can vary by being affected by a temperature and/or humidity of the surrounding environment (outside of the main body LA) in which the apparatus is installed. For example, the temperature and/or the humidity detected by the environmental sensor 2 can vary according to a condition of an air conditioner working in a room in which the image forming apparatus 1 is installed. Therefore, when the present embodiment is applied, an interval (a predetermined time) that the environmental sensor 2 may perform detection is about several minutes to ten and several minutes.

According to the above-described second to fifth embodiments, the water content in the air is used as the determination criterion of the low humidity environment, however, the relative humidity detected by the environmental sensor 2 may be used as the criterion. In other words, the environmental sensor 2 functions as the detection unit for detecting the relative humidity, and the low humidity environment refers to an environment of which the water content in the air is less than a predetermined water content (e.g., less than 10%). A value of the predetermined humidity to be the criterion of the low humidity environment may be appropriately set according to the configuration of the image forming apparatus 1.

The detail configuration can be understood by respectively replacing "the water content in the air" and "the predetermined water content (e.g., 5.0 (g/kg))" to "the relative humidity" and "the predetermined humidity (e.g., 10%)", and thus the descriptions thereof are omitted.

According to the above-described embodiments, the fixing device 27 includes the fixing belt 100 and the pressing roller 600 as a pair of rotary members forming the fixing nip portion N, however, the configuration is not limited to this. For example, a fixing roller having a fluororesin layer on a surface layer may be used as the fixing rotary member, and a pressing belt may be used as the pressing rotary member.

While the present invention has been described with reference to embodiments, it is to be understood that the invention is not limited to the disclosed embodiments. The scope of the following claims is to be accorded the broadest interpretation so as to encompass all such modifications and equivalent structures and functions.

This application claims the benefit of Japanese Patent Applications No. 2016-106456, filed May 27, 2016, and No. 2016-129401, filed Jun. 29, 2016, which are hereby incorporated by reference herein in their entirety.

What is claimed is:

1. An image forming apparatus comprising:

an image forming device configured to form an unfixed toner image on a sheet continuously conveyed;

a fixing device configured to fix the unfixed toner image formed by the image forming device on the sheet while conveying the sheet continuously conveyed from the image forming device, wherein the fixing device includes a first rotatable member of which a surface layer containing a fluororesin is brought into contact with a sheet surface having the unfixed toner image formed by the image forming device and a second rotatable member configured to form a nip portion in cooperation with the first rotatable member;

a receiving unit configured to receive, from an operator, an instruction of a mode to be executed among a plurality of modes including a first mode and a second mode; and a controller configured to control conveyance of a sheet, according to the mode corresponding to the instruction received by the receiving unit, wherein, in a case that the mode corresponding to the instruction received by the receiving unit is the first mode and image formation processing for continuously forming a toner image on a plurality of predetermined sheets is executed, the controller controls the conveyance of the sheet in the image formation processing so that a period from when a trailing edge of a preceding sheet passes through the nip portion till a leading edge of a next sheet reaches the nip portion is a first period, wherein, in the first period, a portion of the surface layer of the first rotatable member, which is brought into contact with the trailing edge of the preceding sheet, is brought into contact with an image area on the next sheet without being contact with a margin area on a leading edge side on the next sheet, and wherein, in a case that the mode corresponding to the instruction received by the receiving unit is the second mode and the image formation processing is executed, the controller controls the conveyance of the sheet so that the period is a second period longer than the first period, wherein, in the second period, the portion of the surface layer of the first rotatable member, which is brought into contact with the trailing edge of the preceding sheet, is brought into contact with the margin area on the leading edge side on the next sheet.

2. The image forming apparatus according to claim 1, wherein the receiving unit includes a display unit, and wherein, in response to an instruction by the operator, the display unit displays a screen for inputting the instruction of the mode to be executed by the controller among the plurality of modes including the first mode and the second mode.

3. The image forming apparatus according to claim 2, wherein, in a case that an instruction corresponding to any one mode of the first mode and the second mode is input via the screen as the mode to be executed by the controller, the controller executes the image formation processing in the same mode unless an instruction to change a mode to be executed is received from the operator via the screen.

4. The image forming apparatus according to claim 2, wherein the display unit displays options of the plurality of modes including the first mode and the second mode on the screen.

5. The image forming apparatus according to claim 1, wherein the first period is longer than a time required for the first rotatable member to rotate one round.

6. An image forming apparatus comprising:

an image forming device configured to form an unfixed toner image on a sheet continuously conveyed;

a fixing device configured to fix the unfixed toner image formed by the image forming device on the sheet while conveying the sheet continuously conveyed from the image forming device, wherein the fixing device includes a first rotatable member of which a surface layer containing a fluororesin is brought into contact with a sheet surface having the unfixed toner image formed by the image forming device and a second rotatable member configured to form a nip portion in cooperation with the first rotatable member;

a detection unit configured to detect a water content in air; and a controller configured to selectively execute one mode instructed by an operator among a plurality of modes including a first mode and a second mode, wherein, in a case that the first mode is instructed by the operator and image formation processing for continuously forming a toner image on a plurality of predetermined sheets is executed, the controller controls conveyance of a sheet in the image formation processing so that a period from when a trailing edge of a preceding sheet passes through the nip portion till a leading edge of a next sheet reaches the nip portion is a first period in each of the plurality of predetermined sheets, wherein, in the first mode, a portion of the surface layer of the first rotatable member, which is brought into contact with the trailing edge of the preceding sheet, is brought into contact with an image area on the next sheet without being contact with a margin area on a leading edge side on the next sheet regardless of the water content in the air, and wherein, in a case that the second mode is instructed by the operator and the image formation processing is executed, the controller controls the conveyance of the sheet in the image formation processing, depending on the water content detected by the detection unit, wherein, in execution of the image formation processing in the second mode, in a case that the water content detected by the detection unit is a first water content greater than or equal to a predetermined water content, the controller controls the conveyance of the sheet so that the period is the first period, and wherein, in execution of the image formation processing in the second mode, in a case that the water content detected by the detection unit is a second water content less than the predetermined water content, the controller controls the conveyance of the sheet so that the period is a second period longer than the first period, wherein, in the second period, the portion of the first rotatable member, which is brought into contact with the trailing edge of the preceding sheet, is brought into contact with the margin area on the leading edge side on the next sheet.

7. The image forming apparatus according to claim 6, further comprising a receiving unit configured to receive an instruction of the mode to be executed by the controller among the plurality of modes from the operator, wherein the controller executes the mode corresponding to the instruction received by the receiving portion.

8. The image forming apparatus according to claim 7, wherein the receiving unit includes a display unit, and wherein the display unit displays a screen for inputting the instruction of the mode to be executed by the controller among the plurality of modes in response to an instruction by the operator.

9. The image forming apparatus according to claim 8, wherein, in a case that an instruction corresponding to any one of mode of the first mode and the second mode is input via the screen as a mode to be executed by the controller, the controller executes the image formation processing in the same mode unless an instruction to change a mode to be executed is received from the operator via the screen.

10. The image forming apparatus according to claim 8, wherein the display unit displays options of the plurality of modes on the screen.

11. The image forming apparatus according to claim 6, wherein the first period is longer than a time required for the first rotatable member to rotate one round.

12. The image forming apparatus according to claim 6, wherein the controller is capable of executing a third mode as one of the plurality of executable modes, and wherein, in a case that the controller executes the image formation processing in the third mode, the controller controls the conveyance of the sheet so that the period is longer than the first period, and the portion of the first rotatable member, which is brought into contact with the trailing edge of the preceding sheet, is brought into contact with the margin area on the leading edge side on the next sheet regardless of the water content in the air.

13. The image forming apparatus according to claim 6, wherein the detection unit includes a sensor configured to measure relative humidity of an environment where the image forming apparatus is set.

14. An image forming apparatus comprising:

an image forming device configured to form an unfixed toner image on a sheet continuously conveyed;

a fixing device configured to fix the unfixed toner image formed by the image forming device on the sheet while conveying the sheet continuously conveyed from the image forming device, wherein the fixing device includes a first rotatable member of which a surface layer containing a fluororesin is brought into contact with a sheet surface having the unfixed toner image formed by the image forming device and a second rotatable member configured to form a nip portion in cooperation with the first rotatable member;

a detection unit configured to detect relative humidity; and a controller configured to selectively execute one mode instructed by an operator among a plurality of modes including a first mode and a second mode, wherein, in a case that the first mode is instructed by the operator in a case that image formation processing for continuously forming a toner image on a plurality of predetermined sheets is executed, the controller controls conveyance of a sheet in the image formation processing so that a period from when a trailing edge of a preceding sheet passes through the nip portion to till a leading edge of a next sheet reaches the nip portion is a first period in each of the plurality of predetermined sheets, wherein, in the first period, a portion of the surface layer of the first rotatable member, which is brought into contact with the trailing edge of the preceding sheet, is brought into contact with an image area on the next sheet without being contact with a margin area on a leading edge side on the next sheet regardless of the relative humidity, and wherein, in the case that the second mode is instructed by the operator and the image formation processing is executed, the controller controls the conveyance of the sheet in the image formation processing, depending on the relative humidity detected by the detection unit, wherein, in execution of the image formation processing in the second mode, in a case that the relative humidity detected by the detection unit is a first relative humidity greater than or equal to a predetermined humidity, the controller controls the conveyance of the sheet so that the period is the first period, and wherein, in execution of the image formation processing in the second mode, in a case that the relative humidity detected by the detection unit is a second relative humidity less than the predetermined humidity, the controller controls the conveyance of the sheet so that the period is a second period longer than the first period, wherein, in the second period, the portion of the first rotatable member, which is brought into contact with the trailing edge of the preceding sheet, is brought into contact with the margin area on the leading edge side on the next sheet.

15. The image forming apparatus according to claim 14, further comprising a receiving unit configured to receive the instruction of the mode to be executed by the controller among the plurality of modes from the operator, wherein the controller executes the mode corresponding to the instruction received by the receiving portion.

16. The image forming apparatus according to claim 15, wherein the receiving unit includes a display unit, and wherein the display unit displays a screen for inputting the instruction of the mode to be executed by the controller among the plurality of modes in response to an instruction by the operator.

17. The image forming apparatus according to claim 16, wherein, in a case that an instruction corresponding to any one mode of the first mode and the second mode is input via the screen as a mode to be executed by the controller, the controller executes the image formation processing in the same mode unless an instruction to change a mode to be executed is received from the operator via the screen.

18. The image forming apparatus according to claim 16, wherein the display unit displays options of the plurality of modes on the screen.

19. The image forming apparatus according to claim 14, wherein the controller is capable of executing a third mode as one of the plurality of executable modes, and wherein, in a case that the controller executes the image formation processing in the third mode, the controller controls the conveyance of the sheet so that the period is longer than the first period, and the portion of the first rotatable member, which is brought into contact with the trailing edge of the preceding sheet, is brought into contact with the margin area on the leading edge side on the next sheet.

20. The image forming apparatus according to claim 14, wherein the detection unit includes a sensor configured to measure relative humidity of an environment where the image forming apparatus is set.

21. An image forming apparatus comprising:

an image forming device configured to form an unfixed toner image on a sheet continuously conveyed;

a fixing device configured to fix the unfixed toner image formed by the image forming device on the sheet while conveying the sheet continuously conveyed from the image forming device, wherein the fixing device includes a first rotatable member of which a surface layer containing a fluororesin is brought into contact with a sheet surface having the unfixed toner image formed by the image forming device and a second rotatable member configured to form a nip portion in cooperation with the first rotatable member;

a detection unit configured to detect a water content in air; and a controller configured to execute a first mode and a second mode, depending on the water content detected by the detection unit, wherein, in a case that the water content in the air detected by the detection unit is a first water content greater than or equal to a predetermined water content, the controller executes image formation processing for continuously forming a toner image on a plurality of predetermined sheets in the first mode, and controls conveyance of a sheet in execution of the image formation processing in the first mode so that a period from when a trailing edge of a preceding sheet passes through the nip portion till a leading edge of a next sheet reaches the nip portion is a first period in each of the plurality of predetermined sheets, wherein, in the first period, a portion of the surface layer of the first rotatable member, which is brought into contact with the trailing edge of the preceding sheet, is brought into contact with an image area on the next sheet without being contact with a margin area on a leading edge side on the next sheet, and wherein, in a case that the water content in the air detected by the detection unit is a second water content less than the predetermined water content, the controller executes the image formation processing in the second mode, and controls the conveyance of the sheet so that the period is a second period longer than the first period, wherein, in the second period, the portion of the surface layer of the first rotatable member, which is brought into contact with the trailing edge of the preceding sheet, is brought into contact with the margin area on the leading edge side on the next sheet.

22. The image forming apparatus according to claim 21, wherein after start-up of the image forming apparatus, in a case that an execution command of the image formation processing is input in a standby state for waiting for input of an execution command in a state ready for starting the image formation processing, the detection unit detects the water content in the air as the execution command of the image formation processing is input.

23. The image forming apparatus according to claim 21, wherein the detection unit detects the water content in the air at every predetermined time, wherein, in a case that the controller starts the image formation processing in a period from when the detection unit detects the first water content to when the predetermined time elapses, the controller executes the image formation processing in the first mode, and wherein, in a case that the controller starts the image formation processing in a period from when the detection unit detects the second water content to when the predetermined time elapses, the controller executes the image formation processing in the second mode.

24. An image forming apparatus comprising:

an image forming device configured to form an unfixed toner image on a sheet continuously conveyed;

a fixing device configured to fix the unfixed toner image formed by the image forming device on the sheet while conveying the sheet continuously conveyed from the image forming device, wherein the fixing device includes a first rotatable member of which a surface layer containing a fluororesin is brought into contact with a sheet surface having the unfixed toner image formed by the image forming device and a second rotatable member configured to form a nip portion in cooperation with the first rotatable member;

a detection unit configured to detect relative humidity; and a controller configured to execute a first mode and a second mode, depending on the relative humidity detected by the detection unit, wherein, in a case that relative humidity detected by the detection unit is a first relative humidity greater than or equal to a predetermined humidity, the controller executes image formation processing for continuously forming a toner image on a plurality of predetermined sheets in the first mode, and controls conveyance of a sheet in execution of the image formation processing in the first mode so that a period from when a trailing edge of a preceding sheet passes through the nip portion till a leading edge of a next sheet reaches the nip portion is a first period in each of the plurality of predetermined sheets, wherein, in the first period, a portion of the surface layer of the first rotatable member, which is brought into contact with the trailing edge of the preceding sheet, is brought into contact with an image area on the next sheet without being contact with a margin area on a leading edge side on the next sheet, and wherein, in a case that the relative humidity detected by the detection unit is a second relative humidity less than the predetermined humidity, the controller executes the image formation processing in the second mode, and controls the conveyance of the sheet so that the period is a second period longer than the first period, wherein, in the second period, the portion of the surface layer of the first rotatable member, which is brought into contact with the trailing edge of the preceding sheet, is brought into contact with the margin area on the leading edge side on the next sheet.

25. The image forming apparatus according to claim 24, wherein, after start-up of the image forming apparatus, in a case that an execution command of the image formation processing is input in a standby state for waiting for input of an execution command in a state ready for starting the image formation processing, the detection unit detects the relative humidity as the execution command of the image formation processing is input.

26. The image forming apparatus according to claim 24, wherein the detection unit detects the relative humidity at every predetermined time, wherein, in a case that the controller starts the image formation processing in a period from when the detection unit detects the first relative humidity to when the predetermined time elapses, the controller executes the image formation processing in the first mode, and wherein, in a case that the controller starts the image formation processing in a period from when the detection unit detects the second relative humidity to when the predetermined time elapses, the controller executes the image formation processing in the second mode.

* * * * *